US011426644B2

(12) United States Patent
Di Prima

(10) Patent No.: US 11,426,644 B2
(45) Date of Patent: Aug. 30, 2022

(54) SPORTING DEVICE

(71) Applicant: STW Designs Intellectual Property Holdings, LLC, Dover, DE (US)

(72) Inventor: Paolo Di Prima, Grapevine, TX (US)

(73) Assignee: STW Designs Intellectual Property Holdings, LLC, Dover, DE (US)

( * ) Notice: Subject to any disclaimer, the term of this patent is extended or adjusted under 35 U.S.C. 154(b) by 11 days.

(21) Appl. No.: 16/848,544

(22) Filed: Apr. 14, 2020

(65) Prior Publication Data

US 2020/0338426 A1 Oct. 29, 2020

Related U.S. Application Data

(63) Continuation-in-part of application No. 29/731,350, filed on Apr. 14, 2020, now abandoned, and a continuation-in-part of application No. 16/785,254, filed on Feb. 7, 2020, now abandoned, and a continuation-in-part of application No. 29/721,342, filed on Jan. 20, 2020, now abandoned, and a continuation-in-part of application No. 16/425,527, filed on May 29, 2019, now abandoned.

(60) Provisional application No. 62/879,018, filed on Jul. 26, 2019, provisional application No. 62/839,856, filed on Apr. 29, 2019.

(51) Int. Cl.
*A63B 69/36* (2006.01)
*A63B 69/00* (2006.01)

(52) U.S. Cl.
CPC ..... *A63B 69/3673* (2013.01); *A63B 69/0002* (2013.01); *A63B 69/3661* (2013.01); *A63B 2069/0008* (2013.01); *A63B 2208/0204* (2013.01)

(58) Field of Classification Search
CPC ..... A63B 69/3673; A63B 69/0002; A63B 69/3661; A63B 2069/0008; A63B 2208/0204
USPC ..... 473/415
See application file for complete search history.

(56) References Cited

U.S. PATENT DOCUMENTS

| | | | | |
|---|---|---|---|---|
| 5,318,290 | A | 6/1994 | Sawyer | |
| 5,976,026 | A * | 11/1999 | Erb | A63B 69/0002 473/270 |
| 8,771,157 | B2 * | 7/2014 | Caponigro | A63B 69/0002 482/79 |
| 9,216,340 | B2 * | 12/2015 | DelGreco | A63B 69/0002 |
| 9,486,683 | B2 | 11/2016 | Goodgame | |
| 2003/0224882 | A1 * | 12/2003 | Mahoney | A63B 69/0002 473/452 |
| 2006/0258486 | A1 * | 11/2006 | Hedgepath | A63B 69/00 473/452 |
| 2011/0092318 | A1 * | 4/2011 | Torch | A63B 69/0002 473/453 |

(Continued)

FOREIGN PATENT DOCUMENTS

WO WO 2010/151023 A2 12/2010

OTHER PUBLICATIONS

European Search Report (ESR) in corresponding European Patent Application No. 20172138.8.

*Primary Examiner* — John E Simms, Jr.
*Assistant Examiner* — Rayshun K Peng
(74) *Attorney, Agent, or Firm* — Ted Whitlock

(57) ABSTRACT

A sporting device providing a rotating footplate and optional foot extension for a user to employ to practice a swing motion using a bat or club commonly used in sports.

22 Claims, 21 Drawing Sheets

(56) References Cited

U.S. PATENT DOCUMENTS

| | | | | |
|---|---|---|---|---|
| 2012/0225741 | A1* | 9/2012 | Antolick | A63B 69/00<br>473/452 |
| 2016/0236053 | A1* | 8/2016 | Frampton | A63B 69/0002 |
| 2018/0161653 | A1* | 6/2018 | Aldoupolis | A63B 69/00 |

* cited by examiner

SPORTING DEVICE

CROSS-REFERENCE TO RELATED APPLICATIONS

This application claims the benefit of U.S. Provisional Application Nos. 62/879,018 filed Jul. 26, 2019, and U.S. Provisional Application No. 62/839,865 filed Apr. 29, 2019, and is a continuation-in-part of and claims priority to, U.S. patent application Ser. No. 16/785,254, filed Feb. 7, 2020, is a continuation-in-part and claims priority to U.S. Design patent application Ser. No. 29/721,342 filed Jan. 20, 2020, and is a continuation-in-part and claims priority to U.S. patent application Ser. No. 16/425,527 filed May 29, 2019, and is a continuation-in-part of U.S. Design patent application Ser. No. 29/731,350, filed Apr. 14, 2020, each of which is hereby incorporated by reference in its entirety.

BACKGROUND OF THE INVENTION

Technical Field

The present invention relates to a system and method for using a sporting device when training or playing various sports.

Description of Related Art

Many sports such as golf or baseball require applying a torque and rotating a foot. As an example, when striking a golf ball, the user's back foot should rotate upon swinging. There is a need for a device which can be used during training or play to assist with the foot rotation.

SUMMARY OF THE INVENTION

The subject invention concerns a sporting device useful for practicing a swing motion in sports involving foot rotation while playing the sport, for example, swinging of a bat in baseball and baseball-like sports, swinging of a club in golf, and the like. The device of the subject invention can be useful in teaching and training proper foot rotation during the swing motion and can be used by players ranging in experience from novice to expert.

The device of the invention described and claimed herein comprises a foot plate supported by a central plate and a central body having a void and a body coupler, wherein the central plate fits within and couples with the void via the body coupler in a manner that permits the central plate to rotate relative to the central void.

To limit the degree of rotation of the central plate within the void, the central plate can include an outer void, and central body can comprise at least one block which extends inward and aligns with the outer void and functions to restrict the rotation of the central plate.

In certain embodiments of a device of the subject invention, the central plate can have an unrestricted rotational degree of freedom, or can be limited to one full rotation of about 360 degrees. In certain embodiments, the rotational degree of freedom for the central plate can be restricted to less than 360 degrees, such as a restricted rotational degree of freedom of about 180 degrees or less, e.g., between about 15 degrees and about 180 degrees. In another embodiment, the central plate can have a restricted rotational degree of freedom of between about 15 degrees and about 90 degrees.

A device of the subject invention can comprise ball bearings which allow and facilitate rotation of said central plate relative to said central body.

In an embodiment, a sporting device according to the invention can comprise a central body having an internal periphery void adjacent to the central plate, wherein said central plate comprises at least one block which extends outward and aligns with the internal periphery void.

A sporting device of the invention can comprise an intermediate plate located below said foot plate and above said central plate.

A sporting device of can further comprise a cover located above the central body and below the foot plate, wherein the cover comprises an internal void, and wherein said intermediate plate fits within the cover internal void.

The sporting device of the invention wherein the foot plate comprises friction knubs on the upper or outer face of the foot plate serving to increase friction and reduce slippage between the foot plate and the foot of the user while in use.

A sporting device of the invention further comprises a base located beneath the central body. One embodiment of a sporting device of the invention can comprise:

ball bearings which allow rotation of said central plate relative to said central body;

an intermediate plate located below said foot plate and above said central plate;

a cover located above said central body and below said foot plate; and a base located beneath said central body.

A sporting device of the invention can further comprise at least one foot extension removably coupled to said body coupler. The foot extension can comprise at least one stop which is moveable for adjustment of its position along the length of the foot extension.

The one or more foot extension can comprise recesses formed therein at intervals along the length of the foot extension, and can further comprise at least one stop which couples with a recess formed in the foot extension. In one preferred embodiment, a device according to the subject invention comprises two foot extensions which can be releasably coupled to one another and wherein one of the two foot extensions releasably couples to the base. The device of the invention can further comprise a body coupler, wherein the body coupler is the body coupler on the central body.

In an alternative embodiment, the sporting device of the invention is a modification of the concept described for the embodiment described above. The sporting device of alternative embodiment comprises a substantially flat, circular base having an outer face and an inner face. The base further comprises an annular side rim around the peripheral outer edge of the base extending upwardly from the base to form a peripheral side wall, thereby forming a bounded base floor inside the peripheral wall. The base with peripheral side wall forms a housing for retaining the rotating components of the sport device.

Within the bounds of the peripheral side rim of the base are tabs which jut inwardly toward a central axis of the base. The tabs are preferably formed integral with the side rim of the base, e.g., are formed as part of the mold during manufacture of the base. The foot plate comprises at least one notched side edge which is matingly positioned relative to the tab formed in the base and serving as a stop when the tab and notch edge contacts one another, thereby restricting rotation of the foot plate to less than 360°.

The base can further comprise one or more flanges extending outwardly from an outer face of its peripheral side rim. The flange is two-fold in function. First, the flange, preferably two to four flanges, provide stability to the base and reduces the tendency of the base to tilt to one side.

Second, the flange can serve as a connecting piece to which a foot extension as described above, can be connected to the base forming a base and foot extension system according to the invention. The base and foot extension can optionally be affixed together using a separate connector.

Disposed on the floor of the base is a centrally positioned axial retaining ring extending upwardly at approximately the same height or less as the peripheral side wall. The retaining ring is adapted for receiving and retaining a ring bearing having a central void which engages an outer edge of the retainer ring. The retainer ring and ring bearing are affixed in a stationary configuration relative to the base. The ring bearing then directly or indirectly engages the foot plate and allows rotational movement of a foot plate relative to the base and ring bearing. The retaining ring can be a separate part affixed onto the floor of the base or can be integrally formed as part of the base floor during manufacture such that the retaining ring is an integral feature of the base floor.

The ring bearing and foot plate engage with one another concentrically, whereby the ring bearing receives a connecting ring, either formed as part of the foot plate or provided as a separate bearing-plate connector. The foot plate and bearing are rotationally engaged, providing for rotation of the foot plate about a central axis relative to the base, which remains stationary during use. The foot plate can include a top surface comprising knubs for gripping between the foot plate and a foot of the user, or can comprise foot plate cover affixed to a top surface of the foot plate as described herein.

Thus, a sporting device of the invention can comprise:

a base comprising a base floor having a retaining ring for receiving a ring bearing, a peripheral side rim and at least one stabilizing peripheral flange having a recessed area for receiving a foot extension, and a rotating foot plate, wherein the base forms a housing for the rotating foot plate which engages the ring bearing and rotates less than 360°.

The base can comprise a tab extending inwardly from the peripheral side rim for limiting rotation of the foot plate to less than 360°. The base can comprise two opposing tabs extending inwardly from the peripheral side rim for limiting rotation of the foot plate.

In one embodiment of the invention, the base has a bottom face comprising gripping ridges. The gripping ridges can be linear and extend radially from a center or central area of the bottom face of the base.

The device of the invention can also include at least one ridge formed on the base floor for increased friction during rotation of the rotating foot plate. The friction ridge can be formed as a plurality of ridges extending radially from the retaining ring to an inner circumference of the peripheral side rim or can be formed as an annular ridge disposed between the retaining ring and an inner circumference of the peripheral side rim. In a preferred embodiment, the base floor comprises radial ridges and at least one annular ridge formed therein or thereon.

The footplate can also comprise friction enhancers on its top surface. Preferably the top surface of the foot plate comprises knubs to provide better gripping properties between the foot plate and a foot of a user. Alternatively, the foot plate can include a cover affixed to the top surface of the foot plate wherein the cover comprises gripping knubs.

The foot plate comprises notches which engage with the at least one tab during rotation of the foot plate, wherein during rotation, the tab and notch engage one another to interfere with and stop the rotation of the foot plate, thereby restricting rotation of the foot plate to less than 360°, preferably less than 180° and more preferably about 90°.

The sporting device of the invention can further comprise at least one foot extension configured to engage with the recessed area formed in the base flange. The foot extension can comprise a plurality of gaps formed along a midline thereof, and can also comprise a cut-out area formed between the gaps and an outer side edge of the foot extension. One or more apertures can be provided in the foot extension for receiving a stake or rod for securing the foot piece to the ground.

In one embodiment of the invention, the cut-out area is configured to include an integral aperture for receiving a stake or rod for securing the foot piece to the ground. In an embodiment, the device of the invention can include two or more foot extensions which are configured to attach or interlock with the base and with one another. For example, a first foot extension affixed to the base can be configured at one end to engage with the recessed areas formed in the base flange and configured at its other end to engage with and couple to a second foot extension. The coupler configuration is preferably standardized such that each foot piece can interlock with the base or with another foot piece.

A foot stop can be provided which is configured to be removably and adjustably disposed in one of the gaps provided in the foot extension. The foot stop provides an optimum stance extension for the user. When the foot extension is not used with the base, a coupler can be provided which engages with the recessed area of the base flange. The coupler can comprise an aperture formed therein for receiving a stake or rod for securing the base to the ground.

The subject invention also concerns a method of practicing a swing motion for a sport using a bat or club, wherein the method comprises providing a device according to the invention described herein;

placing one foot on the rotating plate and the other foot in front of the rotating plate in a stance normally taken by a user when swinging at a pitched or teed ball; and performing practice swings wherein the foot placed on the rotating plate is rotated such that the hips are swiveled in the direction of the rotation of the rotating plate.

The device used in performing the method of the invention comprises a central body having a void; a foot plate supported by a central plate, which fits within the central body void, rotates relative to said central body.

Alternatively, a method of using the invention can be carried out using a device comprising a body coupler for removably coupling at least one foot extension to the base. The method can further include using a device comprising at least one foot extension having a stop which removably engages the foot extension and is movable along the length of the foot extension length, wherein the method comprises:

providing a device of the invention comprising a rotating foot plate and at least one foot extension and at least one foot stop removably engaged with the at least one foot extension;

adjusting said at least one stop along the length of the foot extension to obtain a desired stance;

securing said stop along the length;

placing a first rotating foot on the foot plate;

placing a second off foot on the foot extension adjacent one of said at least one stop; and applying a torque to rotate said first rotating foot.

The application of torque by the user can be achieved by the motion of swinging a golf club or swinging a baseball bat.

It is understood that for the embodiments described above and detailed herein any one or more of the elements or steps can be used separately or together in any combination, including addition, subtraction or substitution of any one or more elements, so long as forming a complete and operable device and useful in accordance with the disclosed method.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein

FIG. 16A is a bottom view of a foot plate for the alternative embodiment of a sporting device employing a base as shown in FIGS. 11-14, and FIG. 16B is a side elevational view of a foot plate for the alternative embodiment of a sporting device employing a base as shown in FIGS. 11-14.

DETAILED DESCRIPTION

Several embodiments of Applicant's invention will now be described with reference to the drawings. Unless otherwise noted, like elements will be identified by identical numbers throughout all figures. The invention illustratively disclosed herein suitably may be practiced in the absence of any element which is not specifically disclosed herein.

Figure 1:
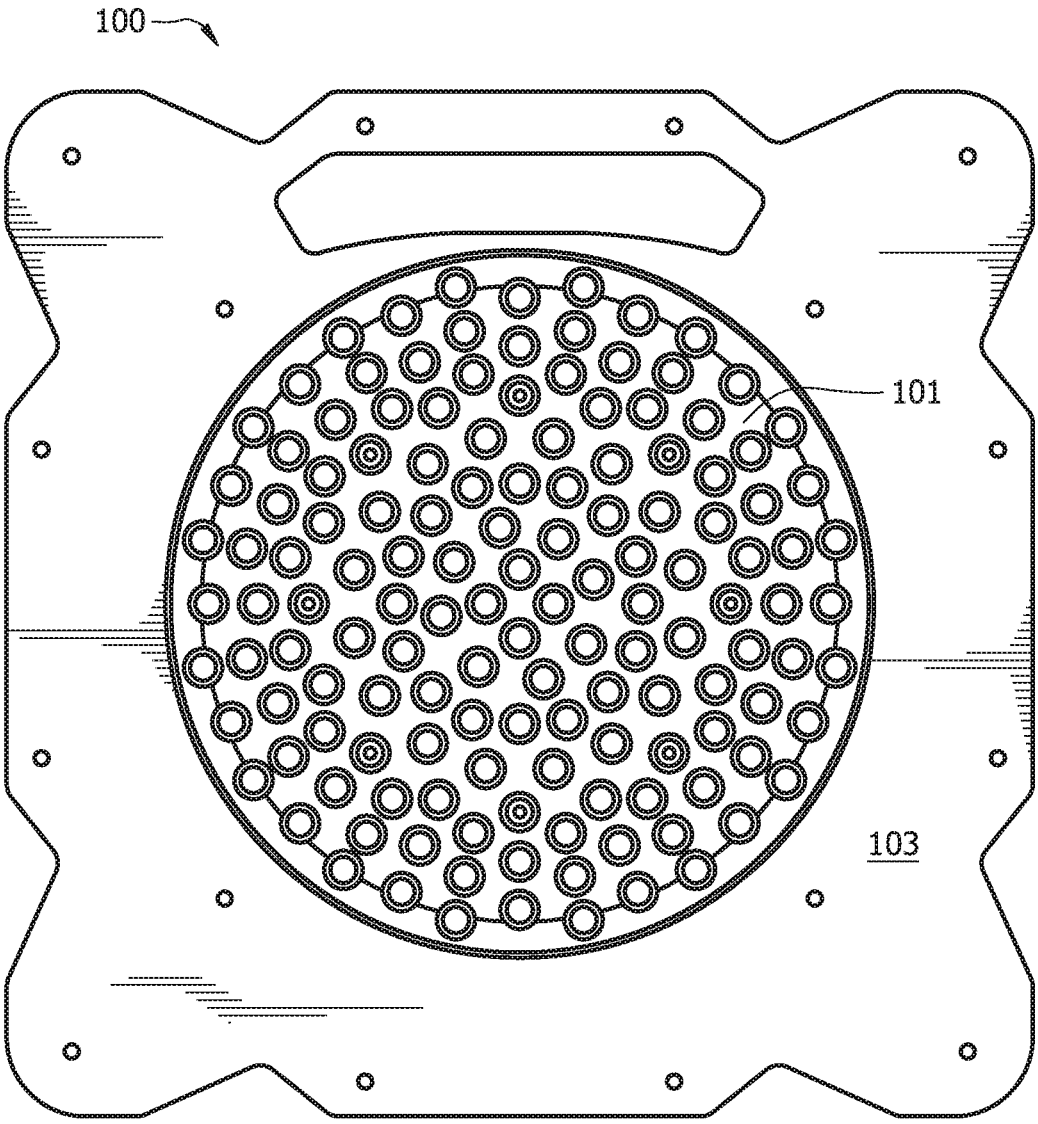
FIG. 1 is a top view of a sporting device in one embodiment.

FIG. 1 is a top view of a sporting device in one embodiment. The sporting device 100 can be used in virtually any sport wherein a foot needs to be rotated during play. The sporting device 100 can be used as a training tool to assist the user in understanding, measuring, and/or controlling the degree of foot rotation. While it can be used during training, the sporting device 100 can also be used during play. Further, while embodiments will be discussed in reference to golf and baseball, this is for illustrative purposes only. This device can be utilized in other sports such as cricket, football, etc.

FIG. 1 shows a foot plate 101 which is slightly suspended relative to the central cover 103. These parts will be described in more detail below herein.

The size and dimensions of the device 100 can vary depending upon the application. In some embodiments the foot plate 101 is sized to fit a single foot. Furthermore, the materials of the device 100 can also vary. The device can comprise metal, plastics, rubber, and combinations thereof.

Figure 2:
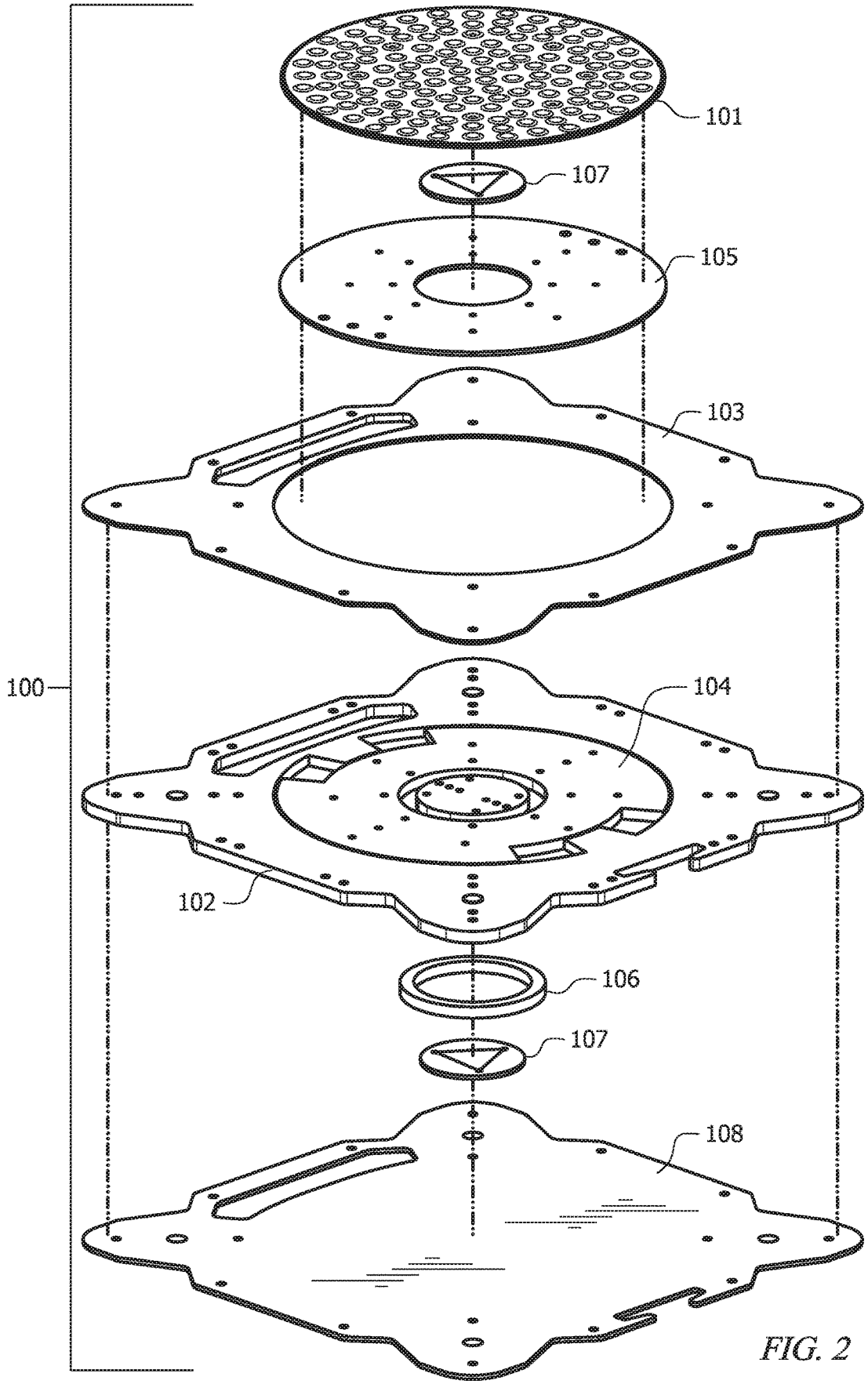
FIG. 2 is an exploded view of a sporting device in one embodiment.

FIG. 2 is an exploded view of a sporting device in one embodiment. FIG. 2 illustrates one embodiment of assembly allowing the foot plate 101 to rotate relative to the central body 102. Those of skill in the art will appreciate that other various tools, parts, etc. can be used to accomplish the goal of having a rotatable foot plate 101.

At the top of the device is the foot plate 101. The foot plate 101 rotates relative to the device 100. As will be described in more detail below, the rotating foot plate 101 reduces friction compared to a foot pivoting on the ground. Because of this reduced friction, the foot is allowed to pivot and rotate, allowing a more open swing. Golfers, as an example, should open their hips when they swing. The back foot should pivot to allow this to happen. Unfortunately, many golfers do not open their hips and the swing suffers. By reducing the friction on the foot plate 101, the momentum of a swing forces the foot to pivot and allow the hip to correctly open. The same is true for a baseball swing. By reducing the friction at the foot plate 101, the user is trained to rotate.

Figure 3:
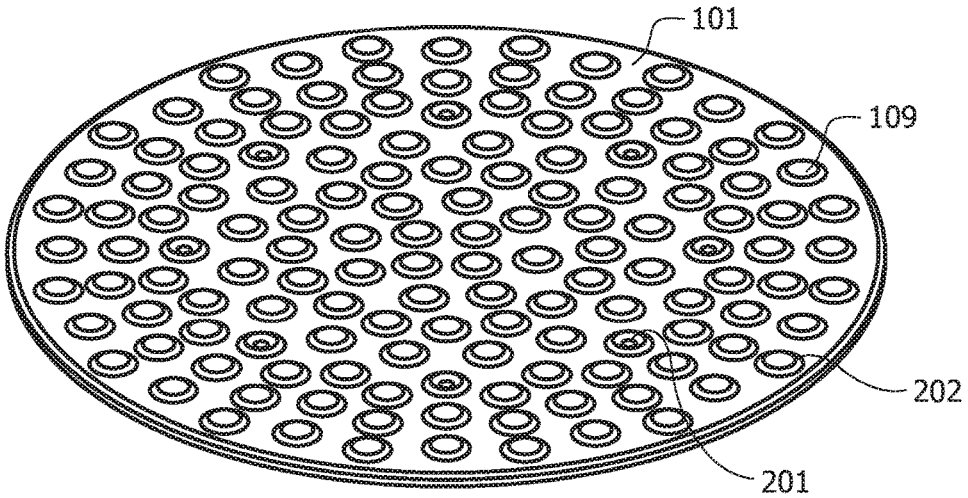
FIG. 3 is a top perspective view of a foot plate in one embodiment.

Turning briefly to FIG. 3, FIG. 3 is a top perspective view of a foot plate in one embodiment. The foot plate 101 can comprise virtually any shape. As depicted the foot plate 101 is circular which allows for easy rotation. The foot plate 101 can comprise features, such as friction knubs 109, which extend outwardly beyond the generally planar face of the foot plate 101. The friction knubs 109 provide for increased grip, allowing the foot to grip the foot plate 101. In one embodiment the foot plate 101 comprises rubber or other material which provides for increased grip. In one embodiment the foot plate 101 raises slightly above the central cover 103 so as to freely rotate with reduced friction.

The knubs are shown in FIG. 3 as being generally circular and distributed in an evenly spaced pattern across the surface of the central cover 103. However, it would be understood that the knubs can be any geometric shape, can be disposed in any pattern, and can have more or fewer knubs than shown, so long as they perform the function of increased grip between the foot of the user and the foot plate.

In addition, the top surface of any individual knub can be flat, concave, or convex, as determined for optimum function and user comfort. FIG. 3 shows knub 201 having a concave top surface and knub 202 having a flat or slightly convex top surface. Alternatively, the knubs can have a rounded top surface. The knubs can be all the same size and shape or one or more of the plurality of knubs can be different from a neighboring knub.

Turning back to FIG. 2, in one embodiment, located beneath the foot plate 101 is the intermediate plate 105 which rotates when in use. The intermediate plate 105 rests within a void of the central cover 103. As shown, the intermediate plate 105 is circular and has an internal void to allow the ball bearings and axis 110 to pass. The intermediate plate 105 raises the foot plate 101 and provides a surface which can support the weight of the foot plate 101 and the user's foot. In one embodiment the intermediate part 105 rotates freely with the foot plate 101. As noted, the intermediate part 105 fits within a central void in the central cover 103.

Figure 6:
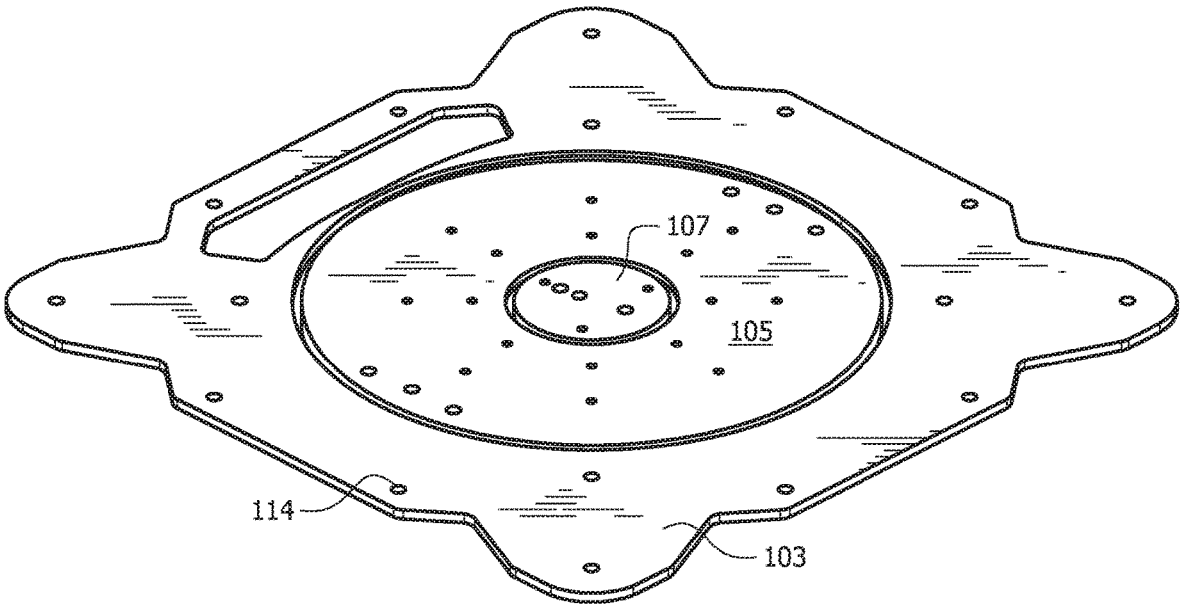
FIG. 6 is a top perspective view of a central cover in one embodiment.

Turning briefly to FIG. 6, FIG. 6 is a top perspective view of a central cover in one embodiment. As can be seen, the central cover 103, the intermediate plate 105, and the ball bearing lock 107, discussed in more detail below, are concentric as depicted. In one embodiment, they are approximately co-planar. In other embodiments, the intermediate plate 105 is slightly raised compared to the surrounding central cover 103.

The cover 103 serves the purpose of covering the central portion 102, described below. It can provide a more refined finish compared to the central portion 102.

Figure 4:
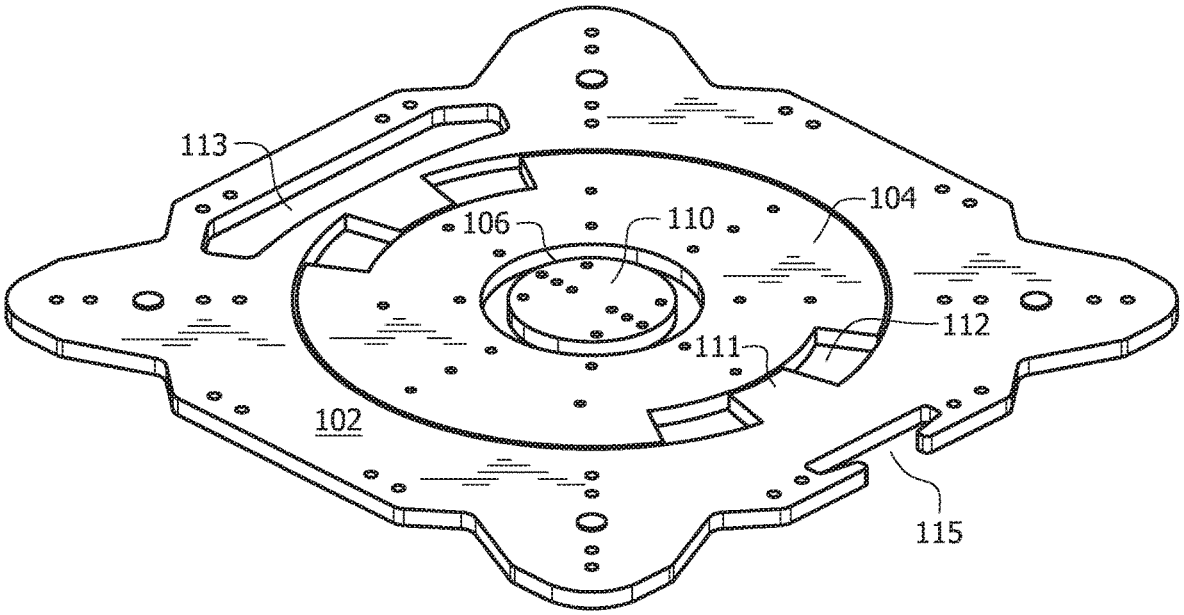
FIG. 4 is a top perspective view of a central body in one embodiment.

Turning back to FIG. 2, beneath the cover 103 is the central body 102. The central body 102 is shown in FIG. 4. The central body 102 is a stationary body which includes an internal cavity or void. The internal cavity is filled with a central plate 104. The central plate 104 rotates relative to the stationary central body 102. The central plate 104 also comprises a central internal void.

As depicted, the internal void in the central plate 104 is circular. Inside the void of the central plate 104 is an axis 110. This is the axis around which the central plate 104 can rotate. The axis 110 can comprise any shape or device which allows the central plate 104 to rotate. In one embodiment, and as depicted, the axis 110 comprises a cylindrical body which is coupled along its periphery to the external central plate 104 via ball bearings 106. Ball bearings 106 reduce friction between two bodies and allow them to rotate relative to one another. Thus, in one embodiment the axis 110 is stationary or fixed, and the ball bearings 106 allow the central plate 104 to rotate relative to the axis 110. As an example, when weight is applied to the central plate 104, the central plate 104 will be able to rotate about the axis 110.

As shown in FIG. 4, the central plate 104 is located in an internal, circular cavity of the central body 102. In one embodiment, the central body 102 comprises one or more blocks 111 which protrude inwardly into the central void.

The blocks 111 coincide with an outer void 112 of the central plate 104. The outer void 112 is located along the periphery of the central plate 104. The blocks 111 extend within the outer void 112 and control the degrees of rotation. The longer the outer void 112, the greater the degrees of rotation before the plate 104 encounters a block 111.

As can be seen in FIG. 4, if the plate 104 is rotated 45 degrees in either direction, the plate 104 will encounter the block 111, and the block 111 will prevent any further rotation. If the length of the outer void 112 is increased, the allowed degree rotation is increased The possible degrees of rotational freedom can vary from one degree to 359 degrees.

In one embodiment the device allows 45 degrees. In other embodiment the device allows between 15 and 90 degrees. In other embodiments the device allows between 30 and 180 degrees. Different applications will require varying degrees of rotational freedom. In one embodiment the central plate 104 is interchangeable and can be replaced with a central plate 104 of different outer void lengths 112. As an example, if a user wants to increase the rotational freedom, the user can replace the central plate 104 with a new central plate 104 having an increased outer void length 112.

While the embodiment depicted shows two blocks 111, this is for illustrative purposes only. In other embodiments a single block 111 is used, whereas in other embodiments, more than two blocks 111 are used. Further, while one embodiment has been depicted wherein the void is located on the inner central plate 104 and the blocks 111 extend outward, the inverse is also utilized in certain embodiments. In such embodiments the blocks 111 extend outwardly from the central plate 104 and the void allowing passage of the block is located on the interior periphery of the central body 102.

As shown the central body 102, and the device 100, comprise a handle 113 for easy carrying. The device 100 can have other features for hanging, storing, etc.

Returning back to FIG. 2, depicted below the central body 102 is the ball bearing assembly 106. As noted, the ball bearing assembly 106 reduces friction and provides rotation between two parts. The ball bearing assembly 106 includes locking ends 107 which ensures the ball bearings stay within the assembly 106.

Figure 5:
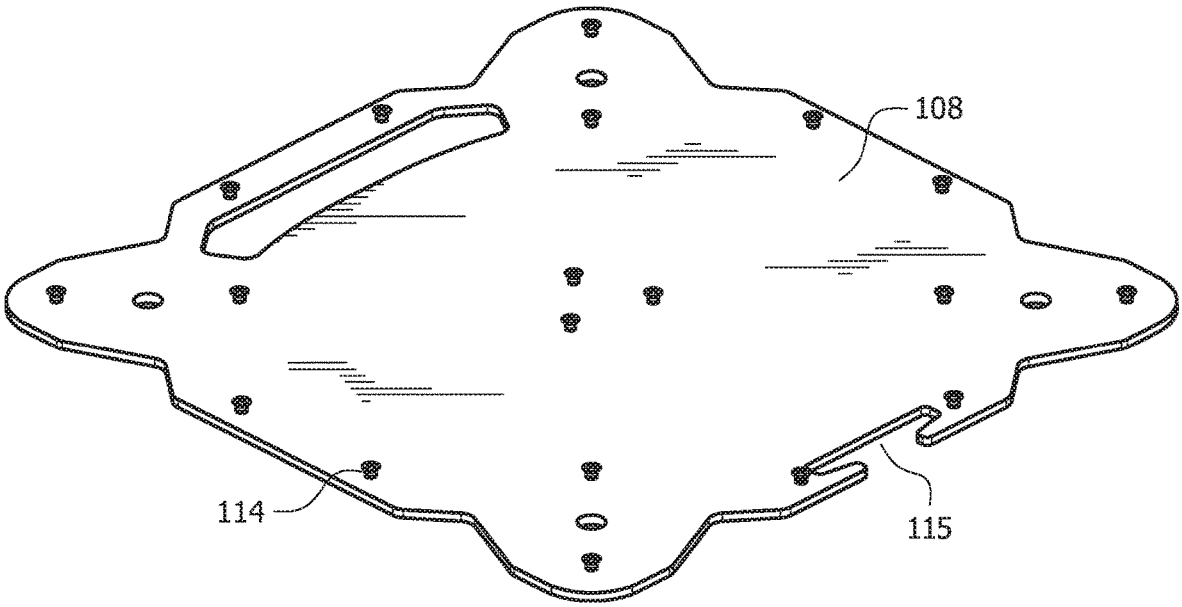
FIG. 5 is a bottom view of a base in one embodiment.

Located below the central body 102 is the base 108. FIG. 5 is a bottom view of a base in one embodiment. The base is not limited in shape or surface features. Another embodiment of the sporting device comprising a variant of the base configuration, is illustrated in FIGS. 11-23. The base provides a flat, generally planar, surface upon which the rest of the device 100 can sit. As shown the base comprises coupling holes 114 which allow the various components to be secured to one another via screws, bolts, or the like. Thus, the base 108 can be coupled to the central body 102 and the cover 103 via the coupling holes 114. Likewise, the ball bearing assembly 106, including the locks can be coupled to the base 108.

The base can comprise features such as spikes, cleats, etc. to help grip into the ground. In other embodiments, the base simply rests upon the ground.

Figure 7:
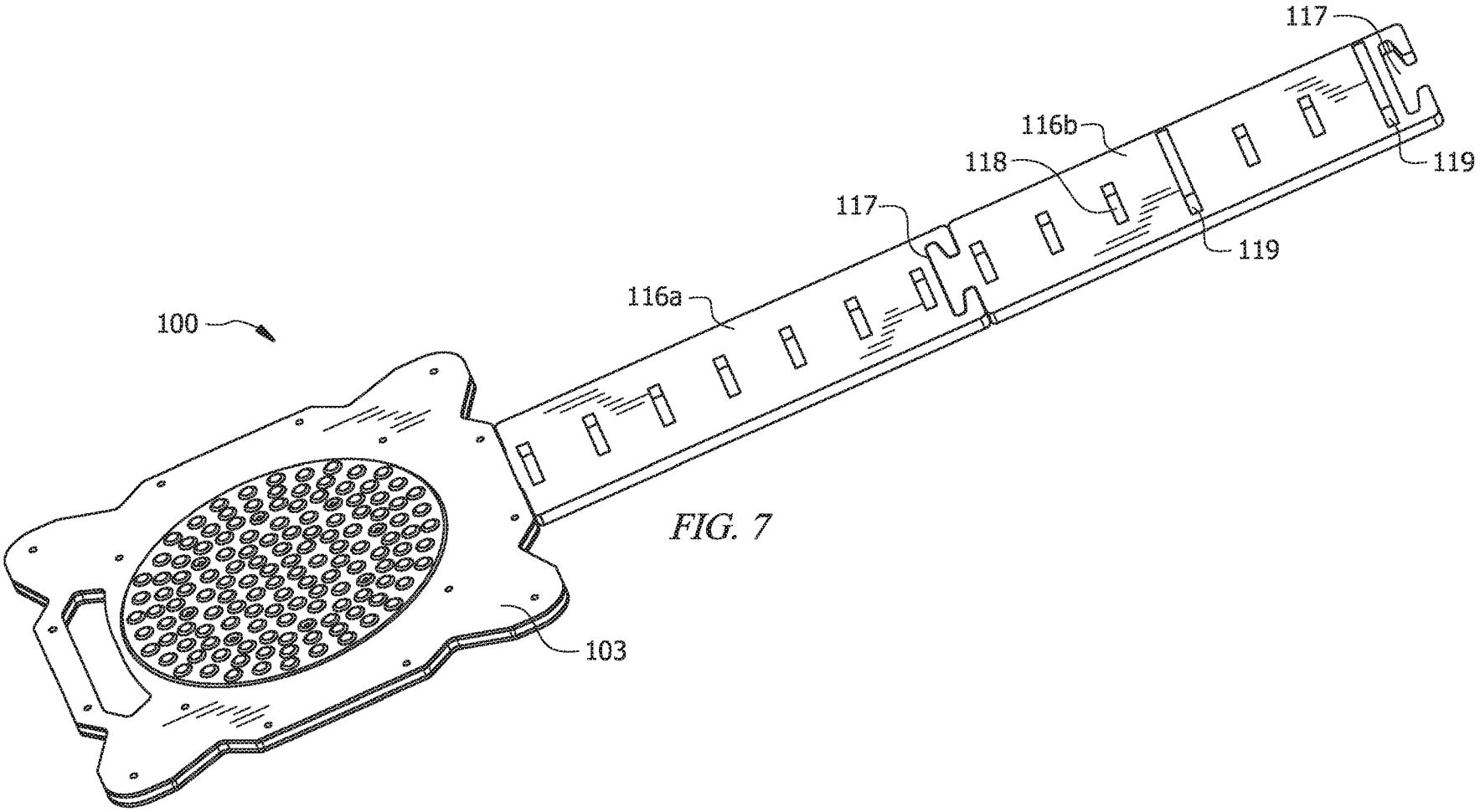
FIG. 7 is a top perspective view of a sporting device with a foot extension in one embodiment.

FIG. 7 is a top perspective view of a sporting device with a foot extension in one embodiment. Often with practicing, be it golf, baseball, etc., the rotating foot is ideally set a specific distance from the planted foot. As an example, when driving a golf ball with a larger club, the golfer wants to have their feet separated by a greater distance than their shoulder width. The foot extension 116 allows the separation to be set.

In FIG. 7, imagine a golfer has their right foot on the foot plate 101 and their left food on the foot extension 116.

The golfer will be facing downward in this situation. When the golfer takes a swing with a driver, their right foot, the foot on the foot plate 101 will rotate. The foot extension 116 allows the off-foot, the left foot in this example, to be set by stops 119 which engage with the foot extension 116. In this instance, the left food of the golfer would be located between the two stops 119 on the right side of the foot extension 116.

The golfer's stance will be adjusted depending upon the club being used. A heavier club generally requires a wider stance, whereas a smaller club requires a narrower stance. The desired stance can be obtained by moving the stops 119 at various locations along the foot extension 116. The placement of the stops 119 is adjustable along the length of the foot extension 116.

Thus, the user can adjust the stops 119 to yield a desirable stance for that specific club, for example. The user would then practice with that specific stance and eventually that stance will become engrained in the golfer's mind. When the golfer changes clubs, the stops 119 can be adjusted to yield a varying stance width.

Thus, the sporting device simultaneously teaches a golfer to pivot the foot while maintaining the proper stance with the off foot. The same benefit is applicable in other sports mentioned above, such as baseball. When hitting a baseball, difference stances are employed. The foot extension 117 allows the user to vary the stance on the off foot.

As depicted, the foot extensions comprise two foot extension segments 116*a*, 116*b* which are removably coupled at their distal ends. Having smaller foot extension segments 116*a*, 116*b* reduces the size of the sporting device. This makes the sporting device more compact and easier to carry. However, in other embodiments the foot extension 116 comprises a single piece which can be longer than the two segmented pieces shown in FIG. 7.

Figure 8:
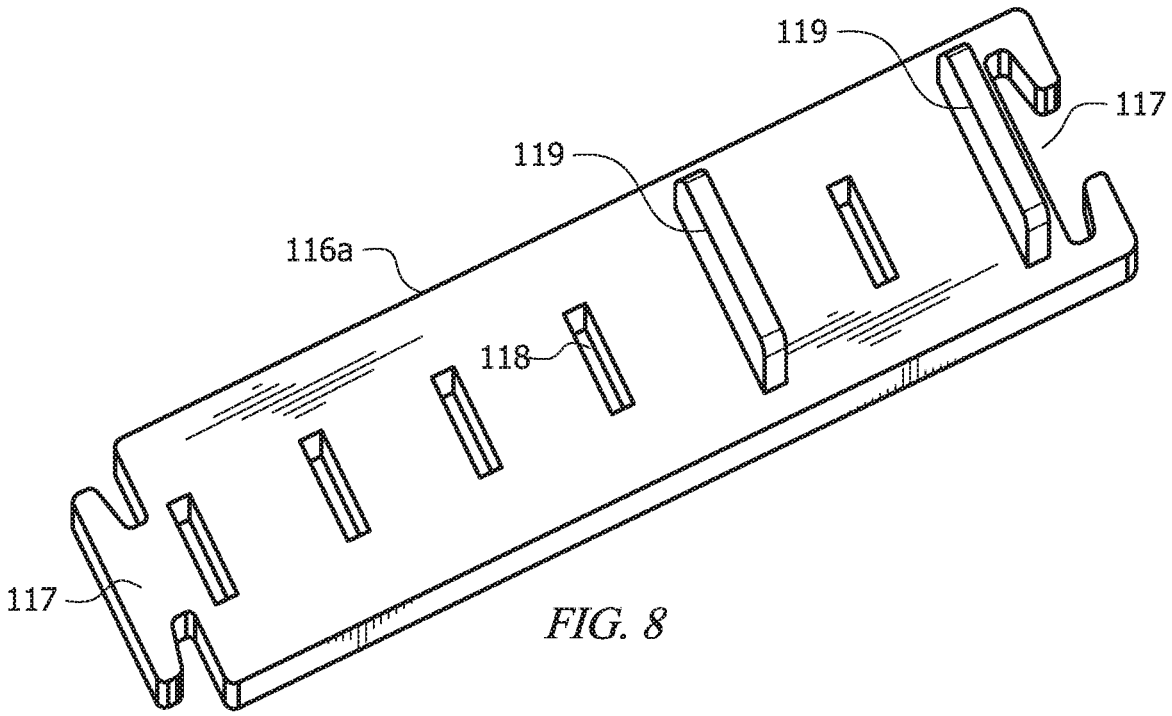
FIG. 8 is a top perspective view of a foot extension in one embodiment.

Turning to FIG. 8, FIG. 8 is a top perspective view of a foot extension in one embodiment. The foot extension 116 has an extension coupler 117 at each distal end. Specifically, it has a male extension coupler 117 on the left distal end and a female extension coupler 117 on the right distal end. This enables this foot extension 116 to be coupled at the distal ends with other similar foot extensions 116. As will be described in more detail later, it also allows the foot extension 116 to be coupled to the sporting device body.

As shown, the foot extension 116 has a plurality of recesses 118 along its length. The recesses 118, rectangular as depicted, receive the stops 119. Having a plurality of recesses 118 provides increased options for locating the stops 119 along the length of the foot extension 116.

It should be noted, that while a mechanical coupling of the stops 119 with distinct and separated recesses 118 is depicted, this is for illustrative purposes only. In other embodiments, for example, the stops 119 are slidably coupled to the foot extension such that the stop 119 can be stopped at any point along the foot extension 116 length as opposed to locations of the recess. As an example, in one embodiment the stops comprise an internal spring to cause tension with the foot extension 116, causing the stops 119 to remain in place. When a user releases that tension on the stop 119, the stop 119 can slide to a new location. In still other embodiments the stops 119 are slidable along the length of the foot extension 116 and are secured in place by a screw, tensioner, or the like. Thus, when the screw or tension is released, the stop 119 is allowed to slide along the foot extension 116. When the stop 119 is in its desired location, the tension is increased and the stop 119 is now in a steady and fixed relationship with the foot extension. Thus, in one embodiment the stops 119 are adjustable along the length of the foot extension 116 to allow proper placement of a user's foot.

As shown in FIG. 8, there are two stops 119. The user would place their foot between the stops 119. To adjust the location of the stops 119, the user would decouple the stops 119 with the recess 118 and then move the stops 119 to a different recess 118.

Figure 9:
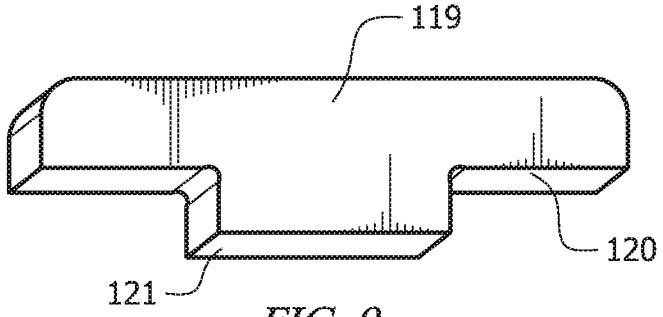
FIG. 9 is a top perspective view of a stop in one embodiment.

FIG. 9 is a top perspective view of a stop in one embodiment. As shown the stop 119 has a generally T-shape. The footrest 120 intersects the knub 121. The footrest 120 is the portion of the stop 119 which engages a foot whereas the knub 121 is the portion which is received by the recess. As noted, while a T-shape stop is depicted, this is for illustrative purposes only and there are other devices to secure the stop 119 to the foot extension 116. One benefit of the mechanical coupling of the stop 119 and the recess 118 is that no external tools or parts are necessary to couple and decouple the stop from the foot extension 116. This is an advantage because, for example, a golfer need not bring a screwdriver to adjust the stop 119 in order to practice a swing.

In one embodiment the stop 119 and/or the foot extension 116 comprises straps, guides, or the like to secure the foot in the desired location. For example, in one embodiment a strap extends between stops 119 to ensure the foot is not removed from the position adjacent the stops 119. The stops 119 and/or foot extension 117 can have straps or guides that couple the front, top, and/or back of the user's foot.

Figure 10:
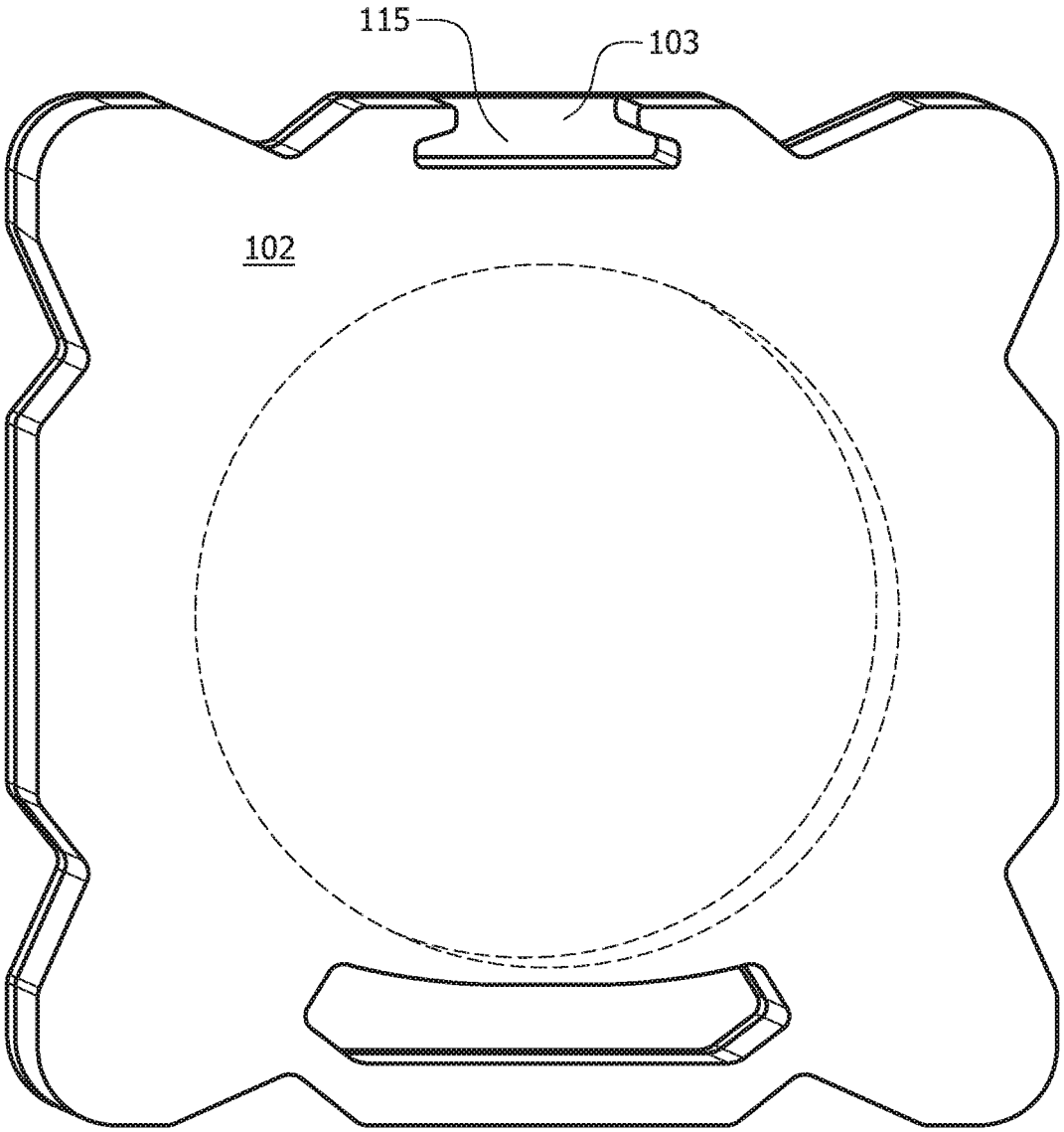
FIG. 10 is a bottom perspective view of a sporting device in one embodiment.

FIG. 10 is a bottom perspective view of a sporting device in one embodiment. As can be seen, one end of the sporting device comprises a body coupler 115. The body coupler 115 can comprise any shape or device known in the art to allow the foot extension 116 to couple with the sporting device 100. In one embodiment, and as depicted, the body coupler 115 comprises a similar couple to the coupler on the foot extension 116. This allows, for example, either segment of the foot extension 116 to engage with the sporting device 100. One benefit of such couplers is that no additional tools are required to assemble the foot extension 116 and couple it to the body coupler 115. Instead, the couplers depicted fit in a male-female relationship like a puzzle. The friction between adjoining couplers maintains them in their desired location.

It should be noted that while mechanical couplers requiring no external parts are disclosed, this is for illustrative purposes only and should not be deemed limiting. The foot extension 116 can be coupled to the body coupler 115 via any method or device known in the art, including but not limited to screws, bolts, snaps, and other such devices.

As can be seen in FIG. 10, the body coupler 115 extends through the central body 102. However, as shown, in one embodiment the body coupler 115 does not extend to the cover 103. Thus, the body coupler 115, as depicted, is not visible from the top side. The cover 103 layer acts to secure the body coupler 115 in place as the received foot extension 116 must stay down below the cover 103.

Figure 11:
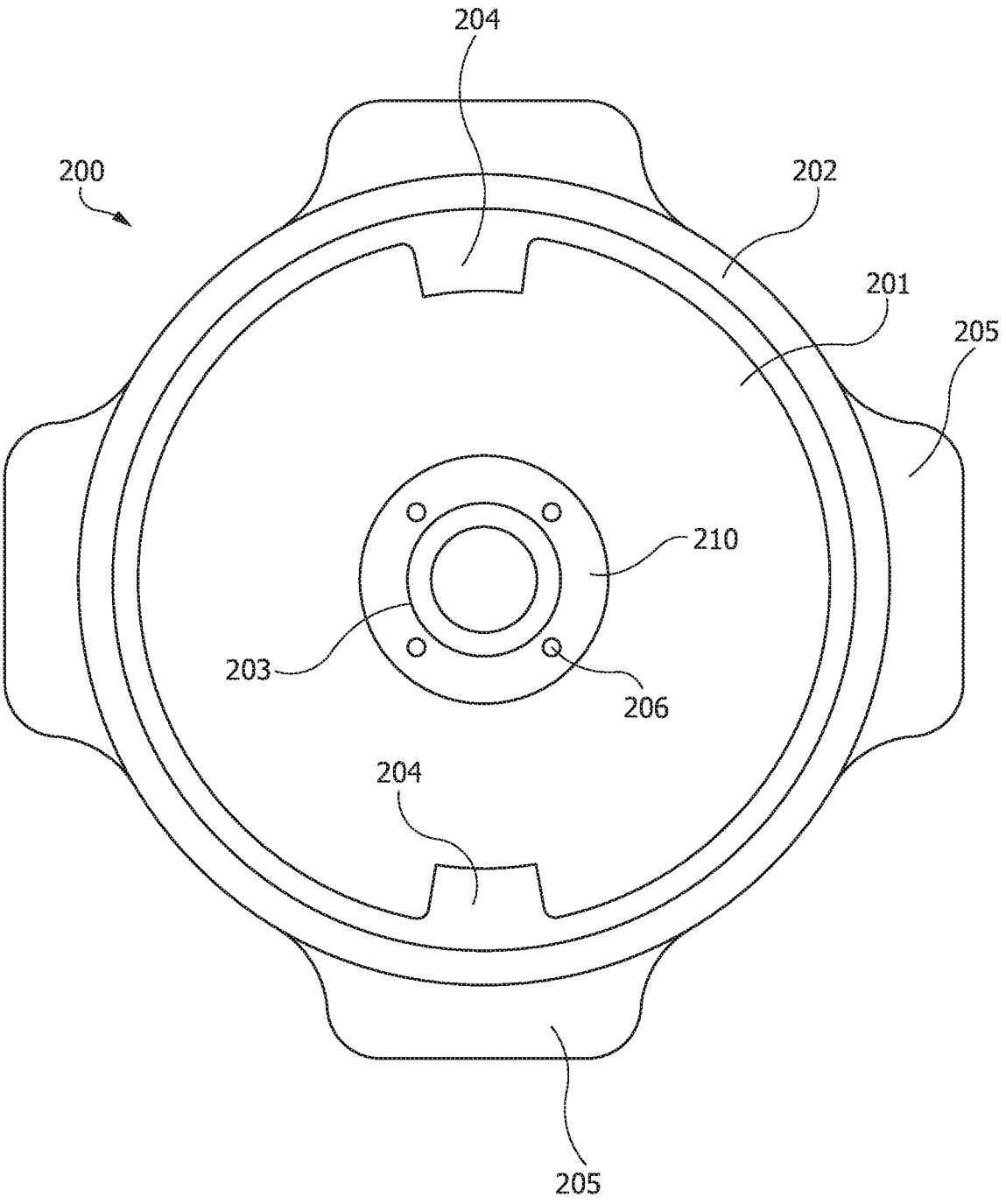
FIG. 11 is a top view of a base for an alternative embodiment of a sporting device of the invention, showing a base comprising inner tabs, outer flanges, and having a top face forming a base floor with a peripheral side rim and having integrally formed therein, a retaining ring.

An alternative embodiment of a sport device according to the invention is illustrated in FIGS. 11-24. Turning to FIG. 11, a top view of an alternative embodiment for the base 200, is shown to illustrate the base configured in a substantially circular shape and forms a housing for the rotating components of the invention. FIG. 11 shows the base has a substantially flat inner face forming a base floor 201 and comprises a peripheral side rim 202 annularly disposed around the outer edge of the base. The peripheral side rim extends upwardly from the floor of the base to form a peripheral side wall, thereby proving a bounded base floor.

Disposed on the floor of the base is a centrally positioned axial retaining ring 203 extending upwardly from the base at approximately the same height or less as the peripheral side wall. The retaining ring is adapted for receiving and retaining a ring bearing. The retaining ring can be a separate part affixed onto the floor of the base or can be integrally formed during manufacture using a molding process as part of the base floor such that the retaining ring is an integral feature of the base floor.

Retaining ring 203 can include a ring flange 210 surrounding retaining ring 203, which provides support for retaining ring 203 and a reinforced area for fasteners received or disposed in or through one or more channel 206.

Also shown in FIG. 11 are tabs 204 for restricting rotation of the foot plate to less than 360°. A base comprising at least one tab is preferred; a base comprising two to four tabs is more preferred; and a base comprising two tabs, as shown, is a most preferred embodiment. The one or more tabs are formed or disposed within the bounds of the peripheral side rim of the base and jut inwardly toward a central axis of the base. The tabs are preferably formed integral with the side rim of the base, e.g., are formed as part of the molded base during its manufacture. The tabs are formed to be matingly positioned to engage a notch (illustrated in FIGS. 16A and 16B) formed in a side edge of a foot plate. The one or more tabs thereby serve as a rotational stop when the tab and notch edge contact one another during rotation of the foot plate relative to the stationary base comprising one or more tabs. It is preferred that the rotation of the foot plate is restricted to less than 360° and is preferably restricted from about 45° to about 180°.

Further, FIG. 11 illustrates the base comprising one or more flanges 205 extending outwardly from an outer face of its peripheral side rim. The flange is two-fold in function. First, the flange, preferably two to four flanges, provide stability to the base and reduces the tendency of the base to tilt to one side.

Second, the flange can serve as a connecting piece to which a foot extension as described above can be connected to the base forming a base and foot extension system according to the invention. In a preferred embodiment, at least one flange comprises a recessed area (not shown, but depicted in FIG. 12) on its bottom face, which can matingly engage with a foot extension having a corresponding matching end. The base and foot extension can optionally be affixed together using a separate connector as described herein and illustrated in FIGS. 23A and 23B.

Figure 12:
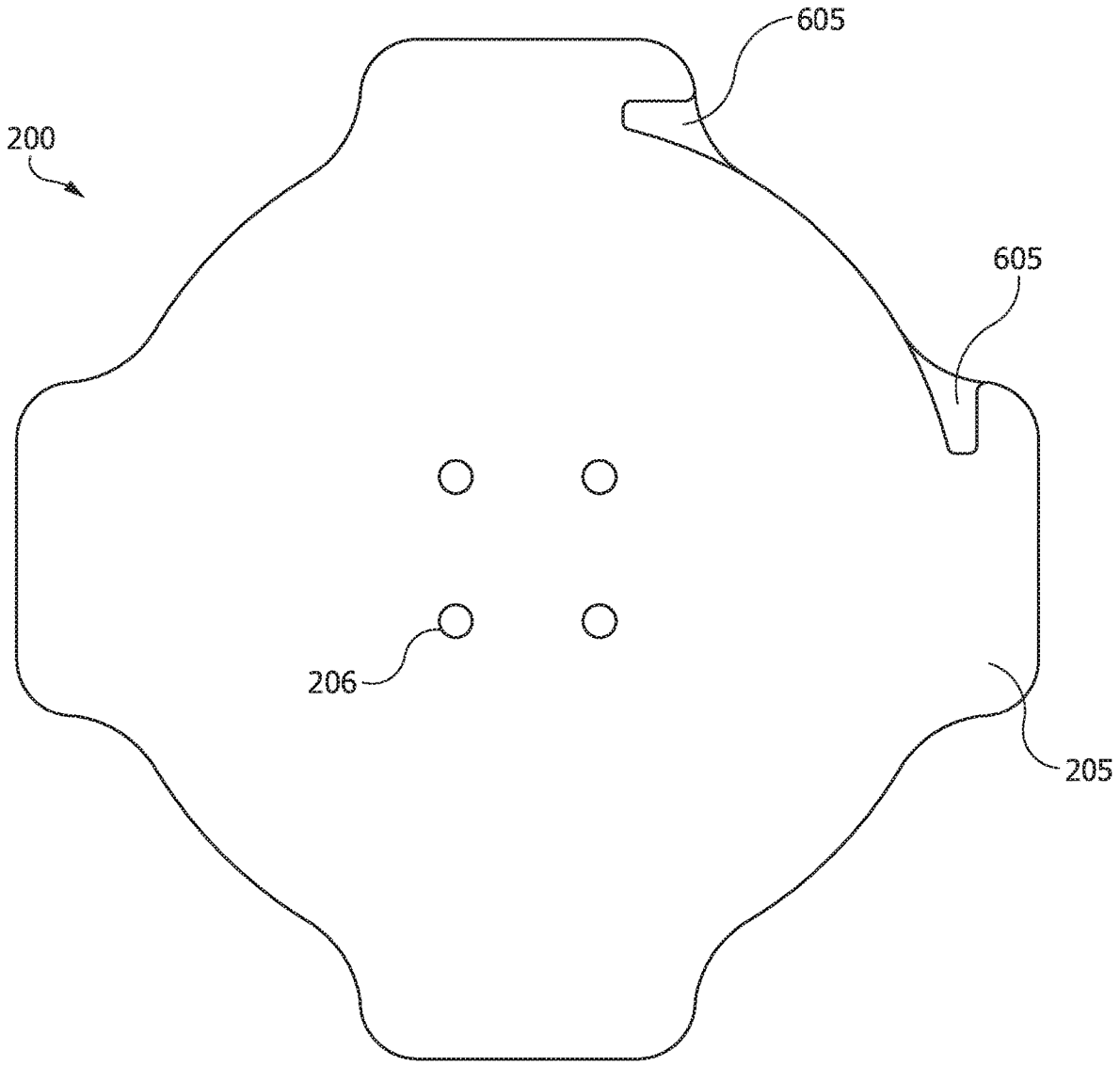
FIG. 12 shows a bottom view of a base for the alternative embodiment of a sporting device of the invention shown in FIG. 11 and illustrating a recess for receiving a foot extension.

FIG. 12 shows a bottom view of a base 200 of the alternative embodiment of a sporting device of the invention using a base as shown in FIG. 11. This embodiment, as shown, comprises one or more channel 206 for receiving fasteners, such as rivets, which extend through the base and affix the retaining ring (not shown) to the base floor. It would be understood that a base comprising an integrally formed retaining ring may not require riveting of the retaining ring to the base floor. However, even where integrally formed with the base, the retaining ring can include rivets to secure the retaining ring in place. It is also understood that other fasteners besides rivets, such as screws, nails, brads, staples, or the like may be used in place of rivets.

Also illustrated in FIG. 12 is a recessed area 605 formed in the bottom face of the flange. The recessed area is preferably provided through only a portion of the thickness of the flange, whereby the recessed area is not exposed and is not seen on the top face of the flange. This configuration of the recessed area can provide for a flush mating of the base and foot extension without a visible connection. The foot extension adjoined to the base having a recessed area as shown, will have an adjoining end which matingly engages the recessed area. As shown, a preferred embodiment comprises at least two recessed areas opposing one another, where a first recessed area is formed in one flange, and a second, opposing recessed area formed in a proximate, second flange.

Figure 13:
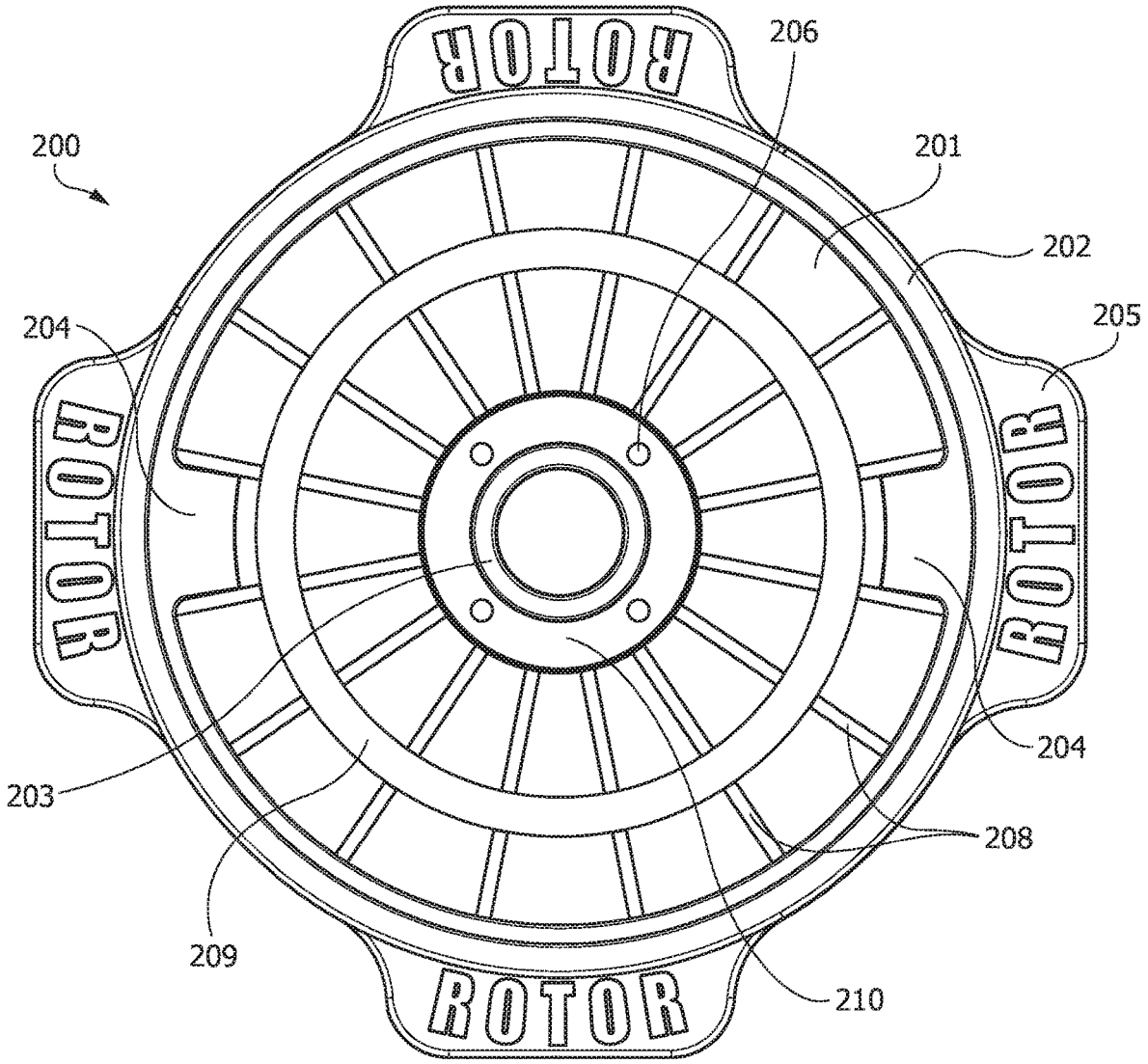
FIG. 13 shows a top view of a base for the alternative embodiment of a sporting device shown in FIG. 11, illustrating radial and circular surface ridges formed on the inner, top face of the base.

FIG. 13 shows another embodiment of base 200 configured the same as base 200 shown in FIG. 11, but further comprising radial and annular ridges formed on the surface of the top, inner face of the base floor. As in the embodiment shown in FIG. 11, this embodiment retains the substantially flat, planar base floor 201, peripheral side rim 202 annularly disposed around the outer edge of the base, and centrally positioned axial retaining ring 203 extending upwardly from the base at approximately the same height or less as the peripheral side wall. The retaining ring is illustrated having a reinforcing flange comprising four channels 206 for receiving fasteners.

This embodiment illustrated in FIG. 13 also retains the inner tab 204 (two tabs 204 illustrated here) and outer flange 205, of which four are shown spaced about 90° apart from one another. In addition to these features in common with the embodiment of FIG. 11, the base in this alternative embodiment can further comprise ridges 208 formed integral with the base floor. These ridges 208 can have a height slightly raised above the base floor, the height being about 2-5 mm, but is limited in that the height is approximately the same as the reinforcing flange of the retaining ring, and does not extend above the peripheral side rim 202. Although not limited in shape or configuration, these ridges are preferably formed as radially disposed "spokes" which extend linearly from the center of the base, starting approximately from the centrally disposed retainer ring 203 and ending approximately at the innermost circumferential edge of the peripheral side rim. The distance which the radial ridges extend can vary and each can be the same or a different length, spanning no more than the distance between the retainer ring to the outer side rim or shorter.

A circular ridge 209, shown annularly disposed about mid-way between the retainer ring and outer side rim, can also be provided. This annular ridge is preferably formed integral with the base floor, and preferably has a height the same as, or slightly higher or lower than the radial ridges. Similar to the radial ridges, the height of the annular ridge is approximately the same as the reinforcing flange around the retaining ring, and is less than the height of the outer side rim, such that the foot plate fits within the base, and is retained by the outer side rim.

Ridges 208 and 209 advantageously provide frictional contact between the base and the foot plate (described below) and provides higher resistance for the rotation of the foot plate when in use as compared to the resistance provided by the ring bearing alone, when the ridges on the inner face of the base floor are not provided.

Figure 14:
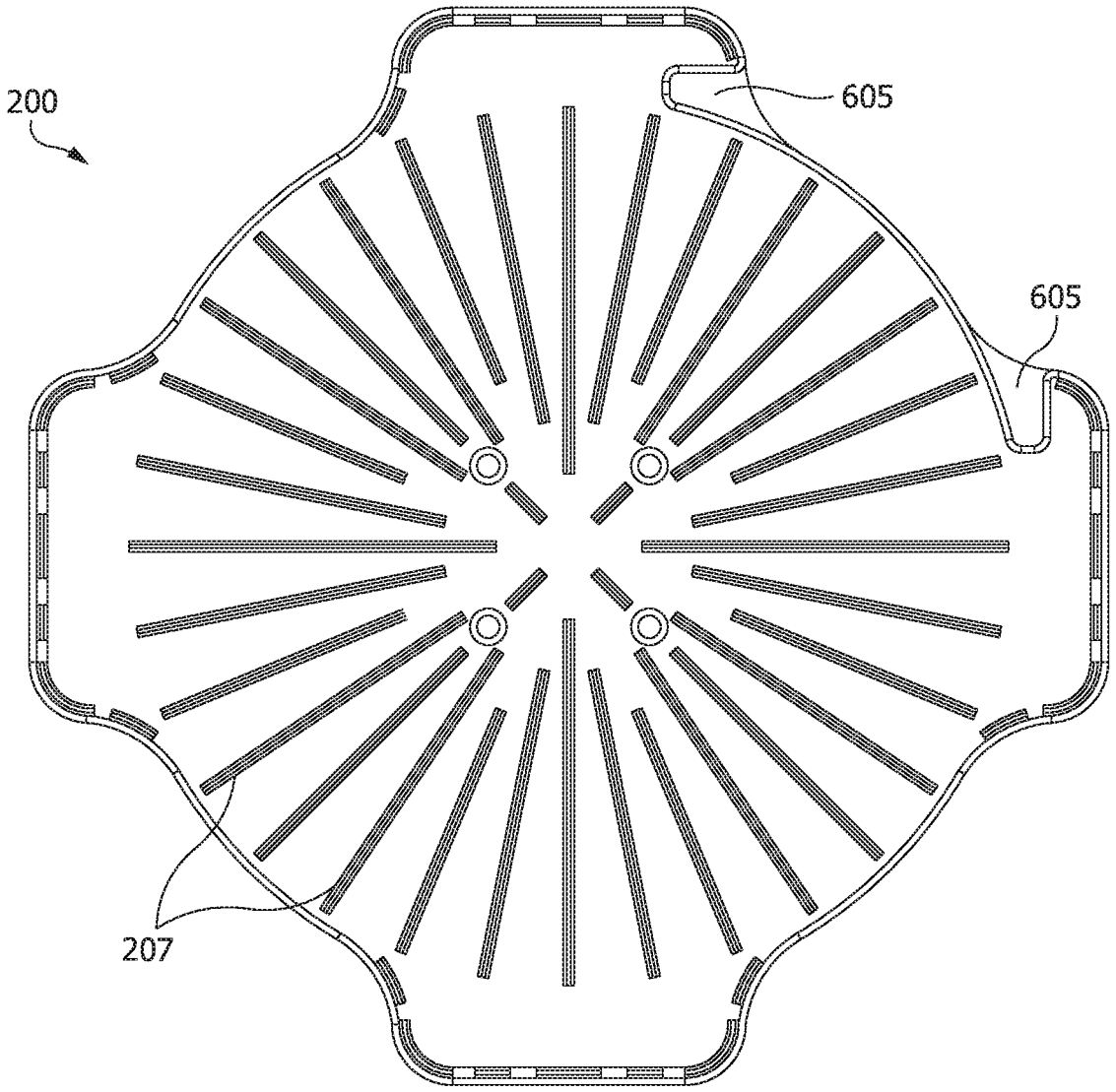
FIG. 14 shows a bottom view of a base for the alternative embodiment of a sporting device shown in FIG. 11, illustrating gripping ridges formed in its bottom surface.

FIG. 14 shows a bottom view of a base for the alternative embodiment of a sporting device using a base as shown in FIG. 11, with recessed areas 605, and illustrating gripping ridges 207 formed on its outer face. These ridges are for illustrative purposes only. Other gripping configurations are contemplated and are included in this invention, and are only limited by aesthetics and ease of manufacture and use.

The embodiments of FIGS. 11-14 can be varied, wherein the base floor can be without ridges, as shown in FIG. 11 and the back face can have ridges, as shown in FIG. 14; the base floor can have ridges, as shown in FIG. 13, and the back face can be provided without ridges as shown in FIG. 12; both the base floor and back face can be without ridges as shown in FIGS. 11 and 12; or both the base floor and back face can have ridges as shown in FIGS. 13 and 14.

Figure 15:
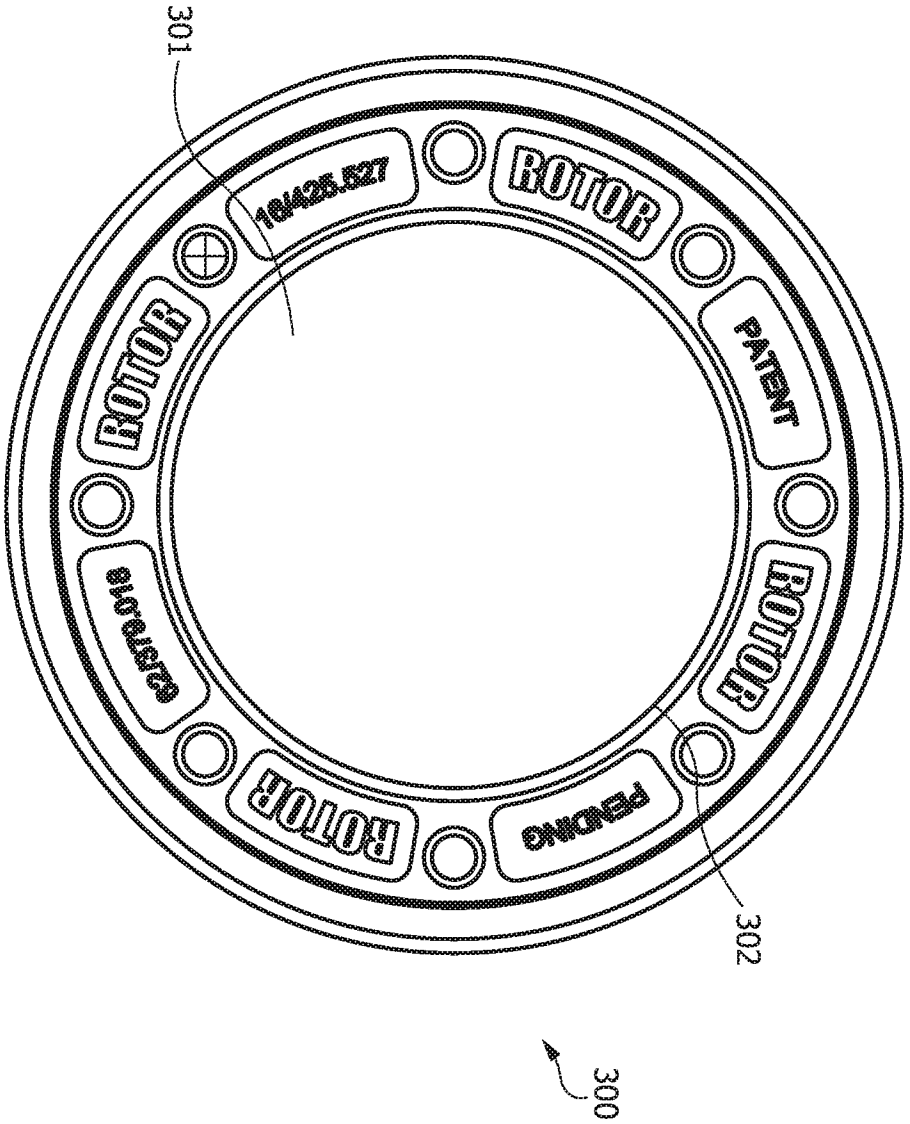
FIG. 15 shows a top view of a ball bearing ring (ring bearing) having a central void which concentrically engages a retaining ring in the base floor of an embodiment employing a base as shown in FIG. 11.

FIG. 15 shows a top view of a ball bearing cassette in a ring configuration (ring bearing) 300 having a central void 301 which concentrically engages the retaining ring in the base floor. Ring bearings are commercially available in various sizes and can be obtained to accommodate the size and configuration of the retainer ring of the base. The ring bearing concentrically engages with a foot plate, whereby the foot plate comprises a bearing connecting means which fits within and engages with the inner circumference 302 of the void formed in the ring bearing.

Figure 16A:
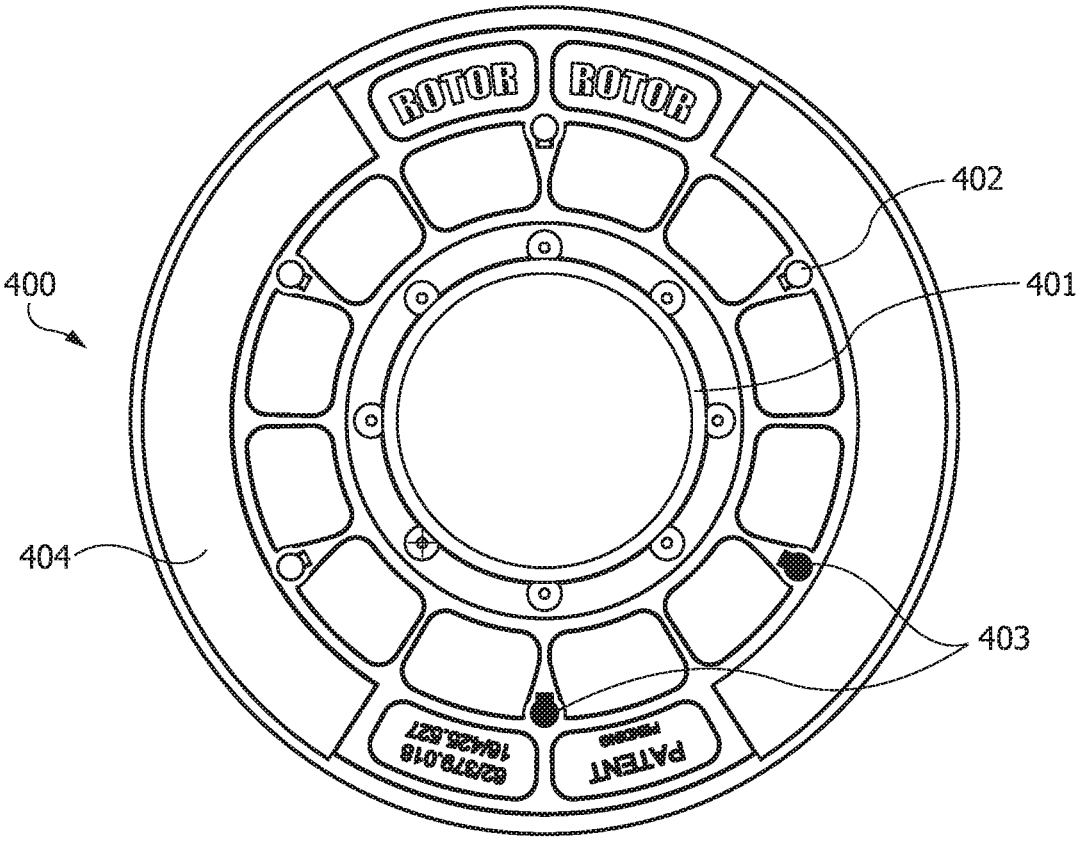
FIG. 16A and FIG. 16B illustrate a foot plate used in an embodiment of the invention.
Figure 16B:
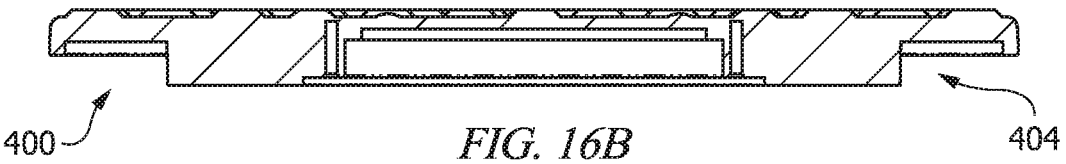

FIG. 16A is a bottom view of a foot plate 400 provided for the alternative embodiment of a sporting device using a base as shown in FIGS. 11 to 14. Gap 404 is a recessed area in the foot plate for engaging the tab 204 when rotating such that the rotation is limited to less than 360°. The foot plate comprises a connecting means for concentrically engaging the ring bearing. The foot plate connecting means can be a ringed flange 401 either formed integrally with the bottom face of the foot plate, or provided separately as a bearing-plate connector. When concentrically engaged with the ring bearing, the foot plate rotates about a central axis relative to the stationary base. A side view of foot plate 400 is shown in FIG. 16B, illustrating the gap 404. Two gaps 404 on opposing sides of the foot plate are illustrated in FIGS. 16A and 16B.

In a further embodiment, spacer slots 402 are provided circumferentially and evenly spaced on the inner face of the foot plate 400 for receiving spacer inserts 403 that can be inserted into the spacer slots. Spacer inserts 403 are shown as solid circles to illustrate inserts disposed within the spacer slot. The spacer inserts are provided to retain a substantially level horizontal plane for the foot plate relative to the base. In instances where the foot of the user is placed off-center onto the foot plate, any tendency for the foot plate to tilt or give under the weight of the user can be offset by the spacer inserts.

These spacer slots and spacer inserts can be placed anywhere on the inner face of the foot plate so long as they serve to balance the plane of the foot plate, horizontally. Spacer slots are typically provided inside the outer circumferential edge of the foot plate, and spaced approximately 60° apart from one another (six in number). At least four spacer slots are preferred, but can be provided in numbers ranging from three to 12.

The spacer inserts, which are inserted and held within the spacer slots, can be made of any material that can bear the weight of the user without substantial deformation. A preferred material for the spacer insert is Teflon®, which can advantageously provide one or more of the desired properties of bearing the weight of the user, facilitating reduction of friction with a contacting surface, and durability, such that it can with can withstand a plurality of—hundreds to thousands or more—of operations without significant wear. The spacer inserts can also reduce wear, including uneven wear, for the base and foot plate, either of which can be damaged by friction during multiple rotations and use. Plastic or rubber materials can also be used for the spacer inserts, whereas metal or other harder materials are less preferred as they may increase wear on the device components contacting the spacer inserts, and can be produce undesirable noise during rotational movement of the foot plate. The spacer inserts can be of any suitable size or shape, and are preferably generally barrel-shaped approximately 5-10 mm in height and about 2-5 mm in diameter. The spacer inserts can be configured to have interlocking notches, threads, or protrusions for matingly engaging a corresponding spacer slot.

The foot plate can preferably comprise on its top face, gripping knubs for increasing gripping properties and preventing slippage between the outer face of the foot plate and the foot of the user. The knubs are illustrated in FIG. 3 as described herein. Alternatively, the foot plate top surface can be substantially smooth and can be provided with a foot plate cover affixed to the flat top surface of the foot plate, as described herein, wherein the foot plate cover comprises gripping knubs.

Figure 17:
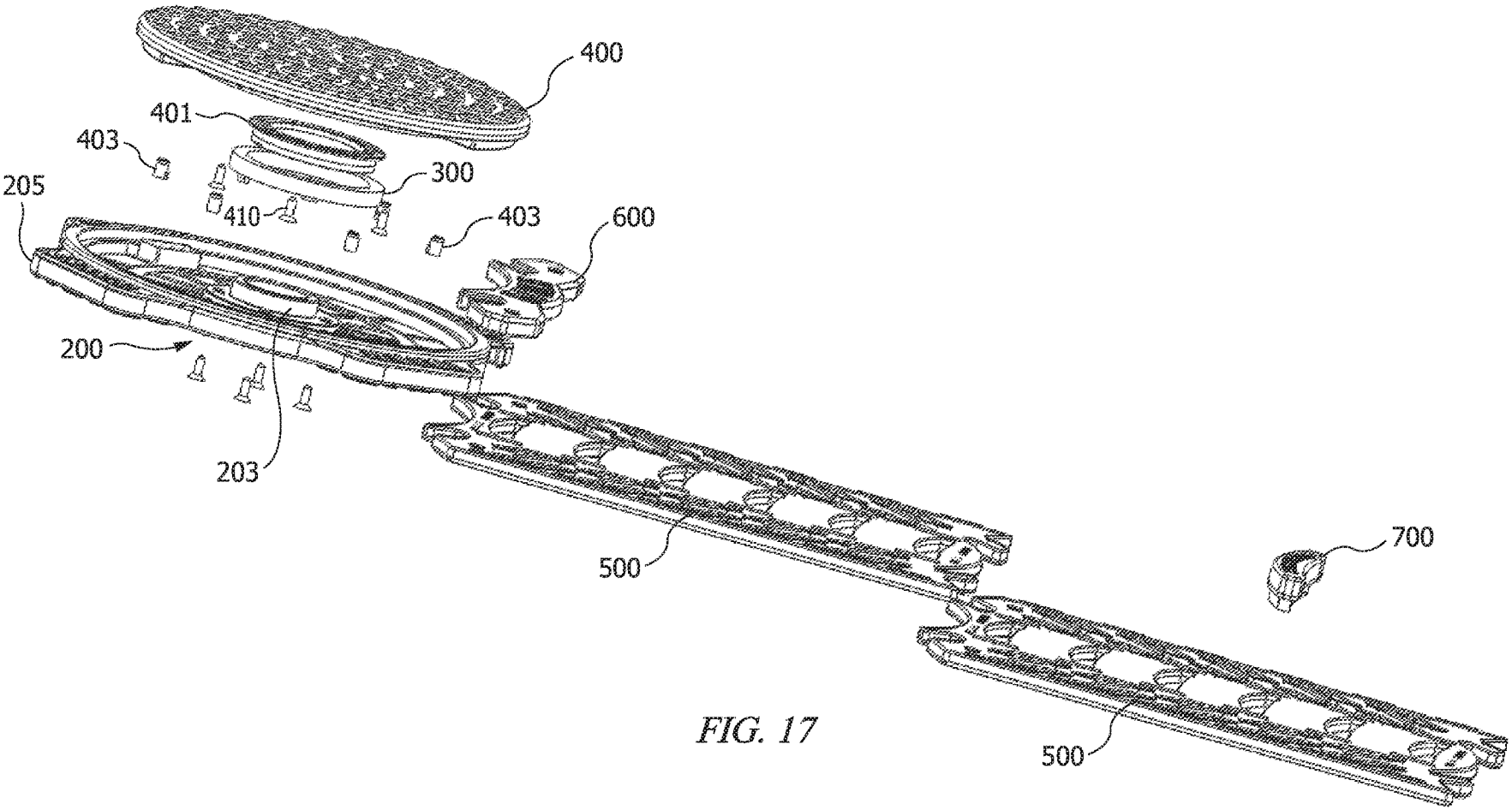
FIG. 17 is an exploded view of a sporting device having a base as shown in FIG. 13, and further illustrating the sporting device comprising the base, ring bearing, foot plate (shown having a bearing-plate connector), two foot extensions, a coupler and a foot stop.

To further illustrate the components in the alternative embodiment of the sport device of the invention, attention is directed to FIG. 17, which shows an exploded view of a sporting device using a base shown in FIGS. 11-14. This FIG. 17 illustrates the positional relationship of the components described above, and in particular, shows base 200 with flanges 205, and ring bearing 300, which fits over and engages with retainer ring 203, and receives foot plate 400 via ring flange 401. As described, the ring flange can be a separate bearing-plate connector as shown, or can be integrally formed with the bottom face of the foot plate such that the ring flange extend downwardly from the bottom face of the foot plate and engages the ring bearing. FIG. 17 further shows fasteners 410, which are disposed through base 200 and engage with foot plate 400. Spacer inserts 403 are also illustrated in their positional relationship disposed between foot plate 400 and base 200. Also illustrated in FIG. 17 are two foot extensions 500, an optional coupler 600, and optional foot stop 700.

A top view of an assembled sport device of this embodiment of the invention is shown in FIG. 18, again showing the base 200 (exposed as peripheral side rim 202 with flanges 2050 fittingly bounding foot plate 400 engaged therewith. Connected to base 200 are shown two foot extensions 500 matingly adjoined to the base by way of the recessed area shown in FIG. 12 (not visible in this view). In this configuration, the optional coupler for adjoining the base and foot extension is not required, as the base and foot extensions are matingly configured to adjoin with one another.

It would be understood that one foot extension may be used or a plurality of foot extensions, e.g., two, three, four, or more, may be used, depending on the length of each foot extension and the distance needed to be spanned by the foot extension. Typically, the number of foot extensions required are the amount to span the distance of an extended stance and forward step taken by a user during a swing of a club or bat. For example, a child or small adult may utilize a single foot extension where a larger person or adult may use two or more foot extensions.

Figure 18:
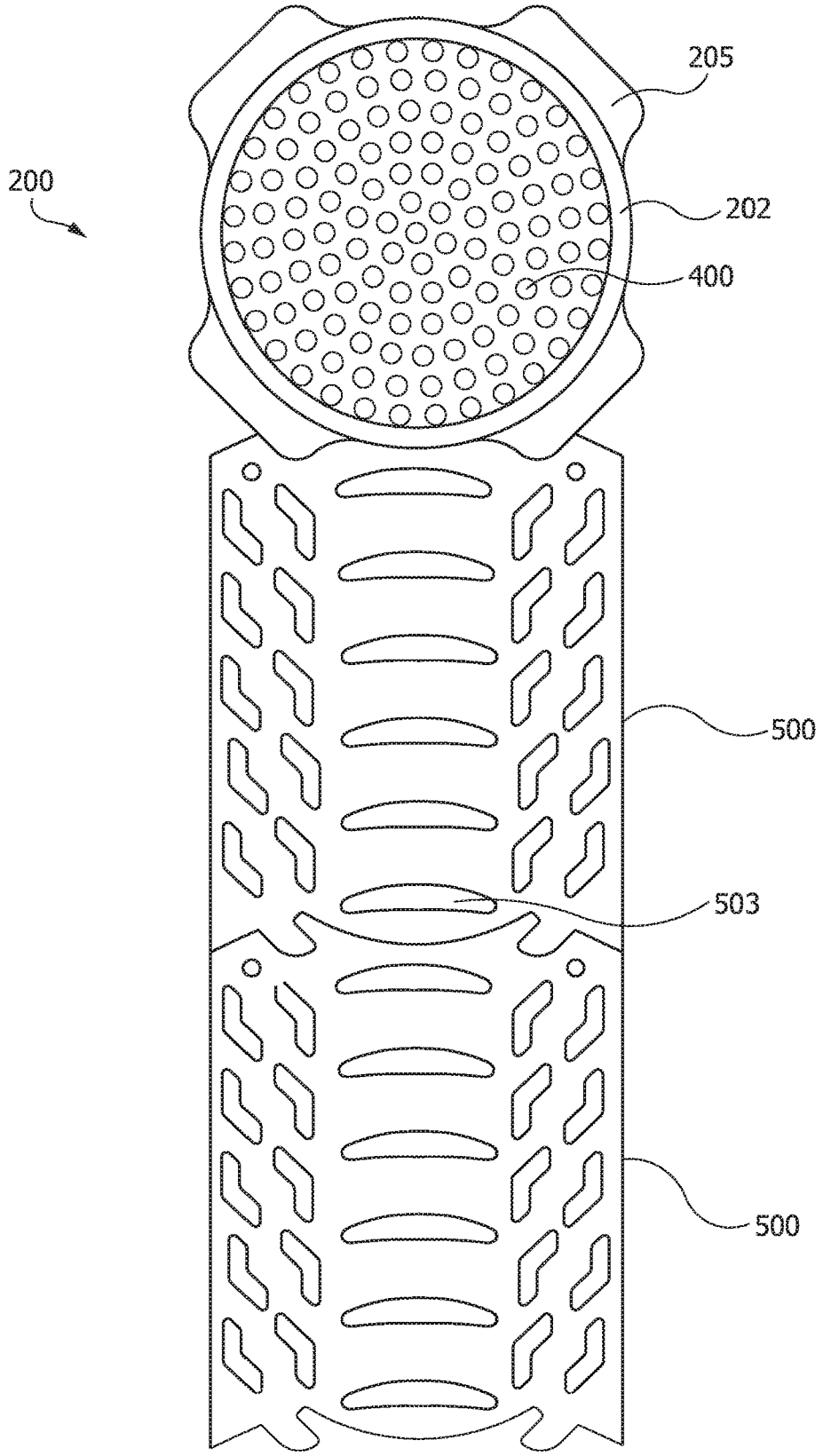
FIG. 18 is a top view of an assembled sporting device according to an alternative embodiment of the invention, showing a base and foot plate cover comprising knubs affixed to a foot plate, and two interconnected foot extensions connected to the base at one end of one foot extension.

An optional foot stop shown in FIG. 17 is not shown in FIG. 18 but, when present, would be removably positionable in the gaps 503 formed along the longitudinal midline of the foot extensions. One or more gaps 503 can be provided in the foot extension.

Figure 19:
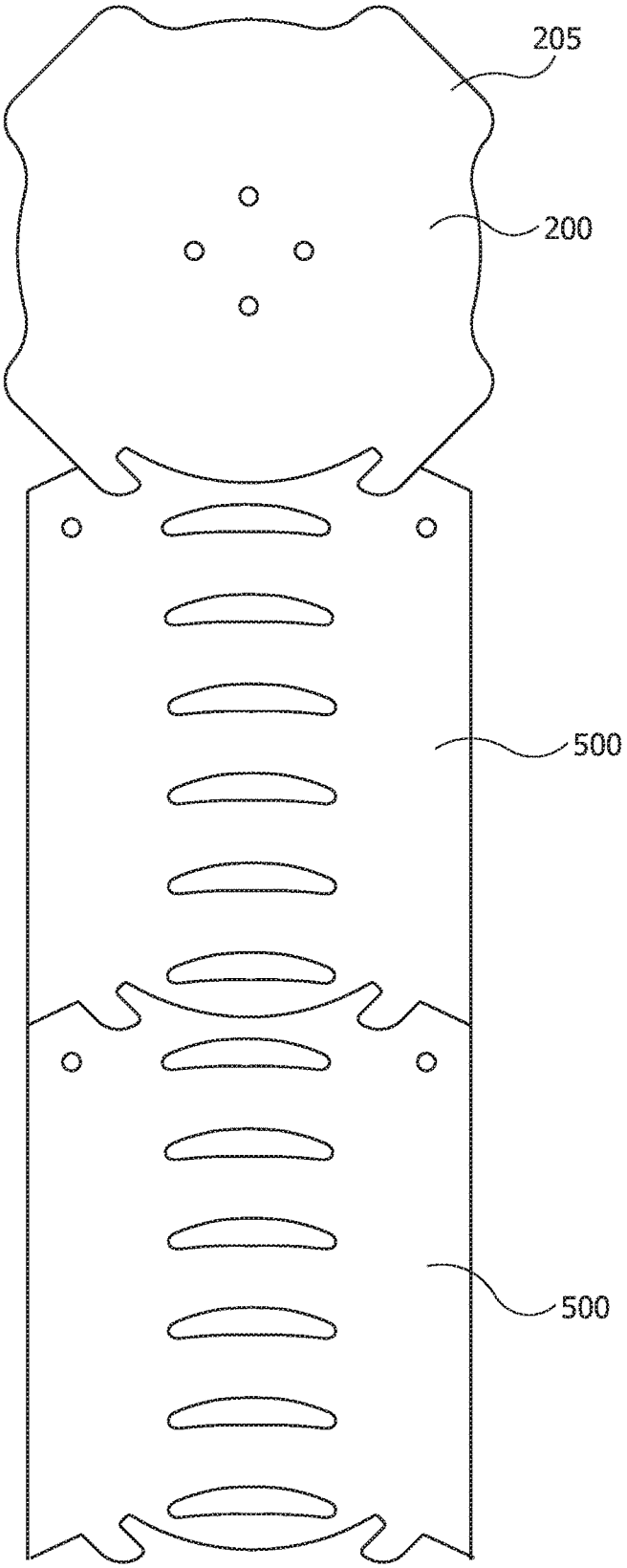
FIG. 19 is a bottom view of an assembled sporting device of FIG. 18.
Figure 20:
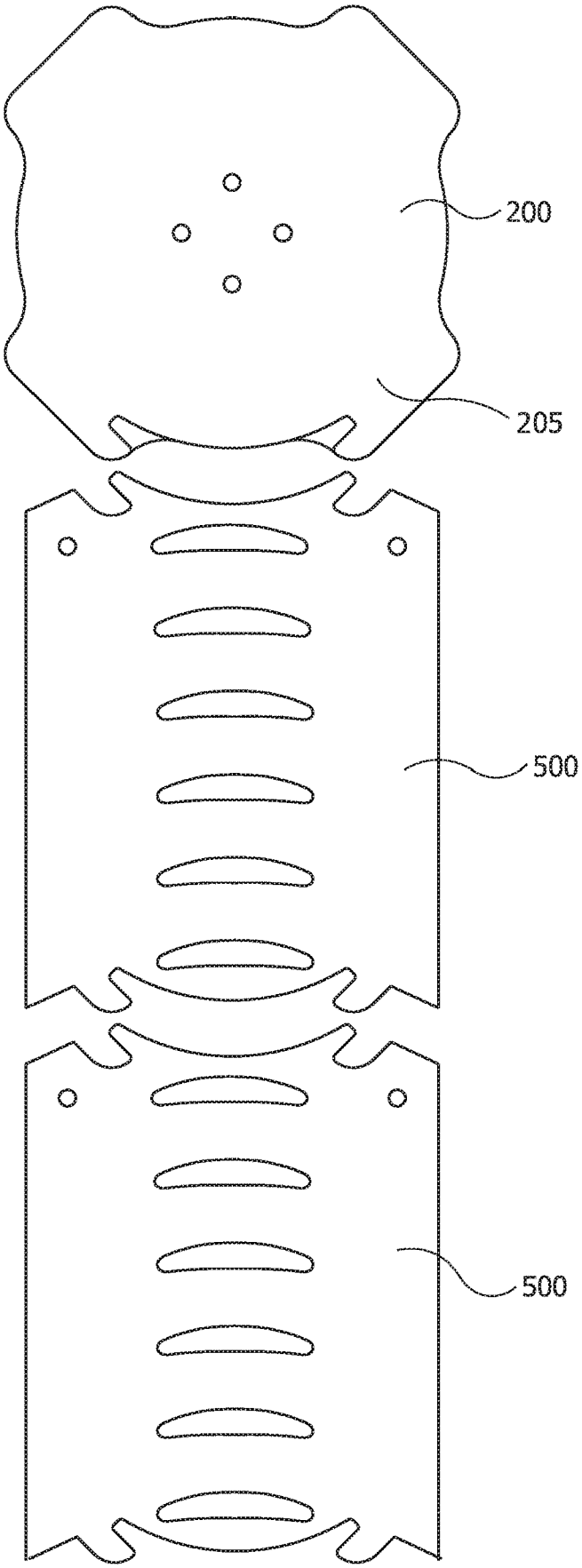
FIG. 20 is an exploded bottom view of the sporting device of FIG. 19.

FIG. 19 is a top view of a back face of the assembled sporting device shown in FIG. 18. FIG. 20 is the same view as in FIG. 19, but presenting an exploded view showing the base and foot extensions disassembled, or not adjoined to one another.

Figure 21:
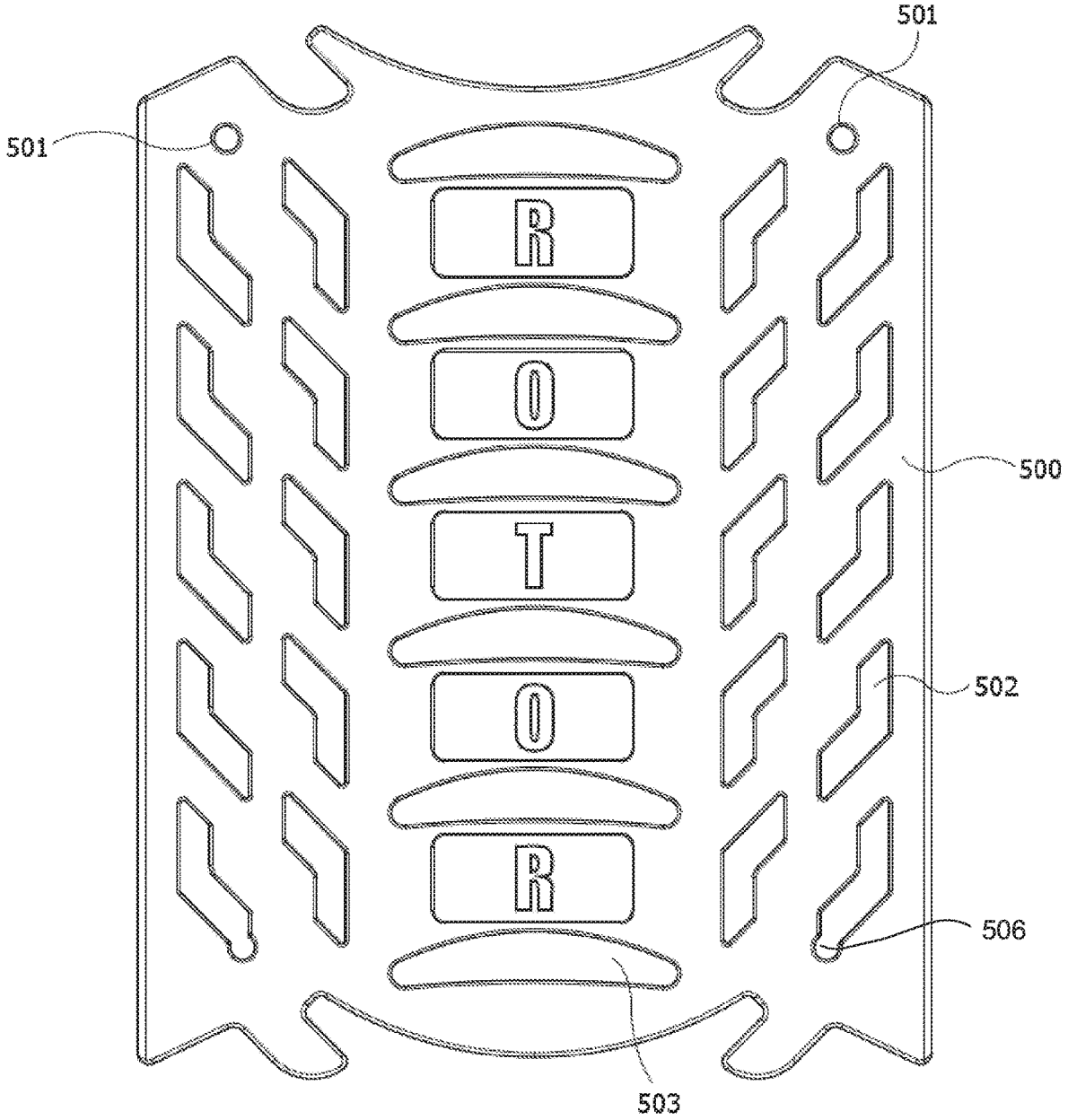
FIG. 21 is a top view of an alternative embodiment of a foot extension.
Figure 22:
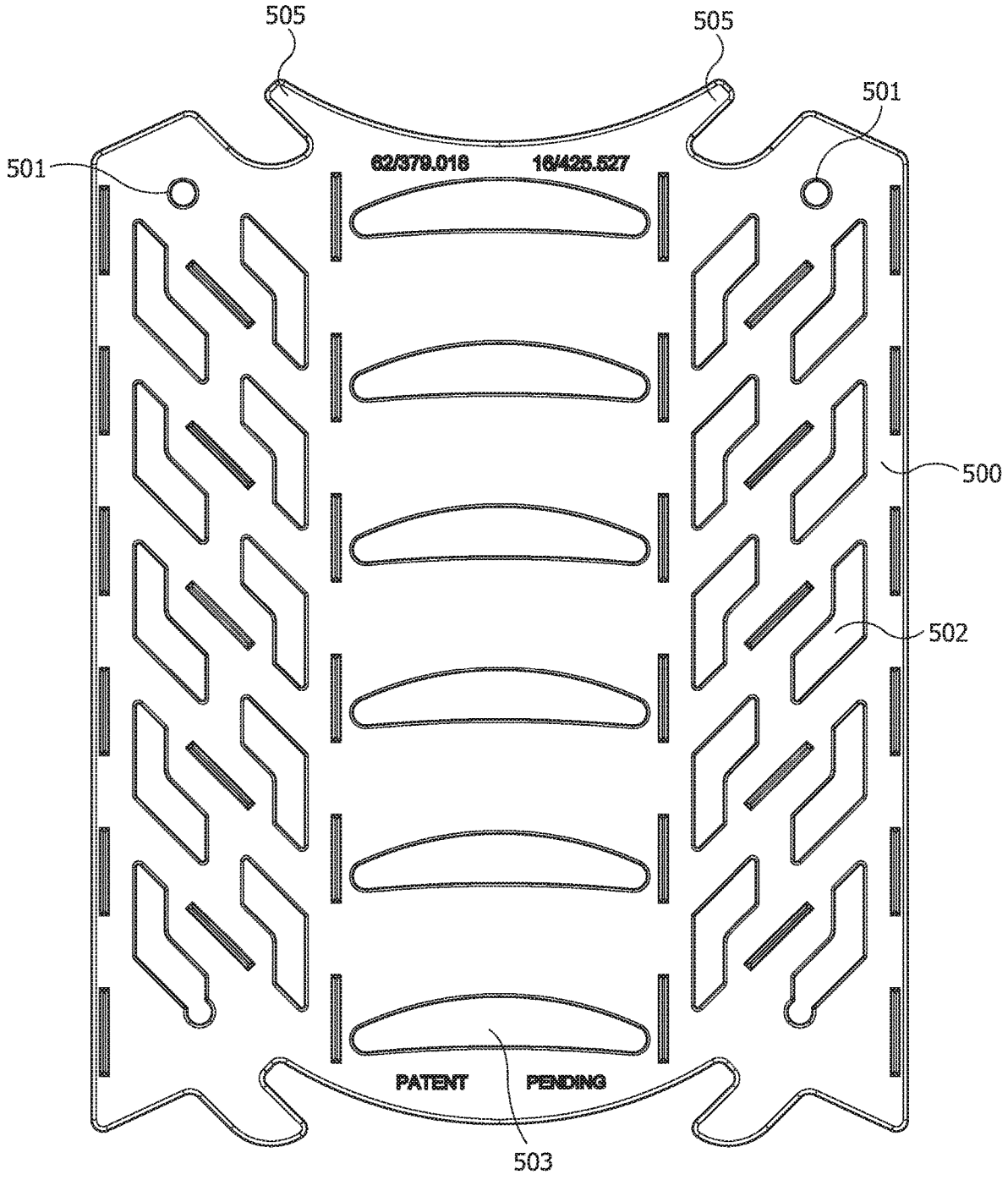
FIG. 22 is a bottom view of the foot extension of FIG. 21.

FIGS. 21 and 22 are top views of, respectively, a front face and back face of a foot extension 500 as described herein for an alternative embodiment. FIGS. 21 and 22 are provided to illustrate that apertures 501 may be provided wherein securing stakes or rods may be inserted to secure the foot extensions to the underlying surface, preferably the ground. As shown in FIG. 21, cut-out areas 502 are provided for aesthetic purposes but can also serve to reduce weight of each foot extension.

Gaps 503 are receptacles for a foot stop, and can be positioned anywhere along the axial length of the foot extension, and are preferably evenly spaced to provide varying distances for stopping the forward foot during a swing when using the device. Corresponding apertures 501, cut-out areas 502, and foot stop gaps 503, as shown in FIG. 21, are also shown in the bottom view FIG. 22. It would be readily understood that a foot stop, exemplified herein and shown in FIG. 9, may be provided in various configurations, including being configured so that it can matingly engage with the foot stop gap 503.

Figure 23A:
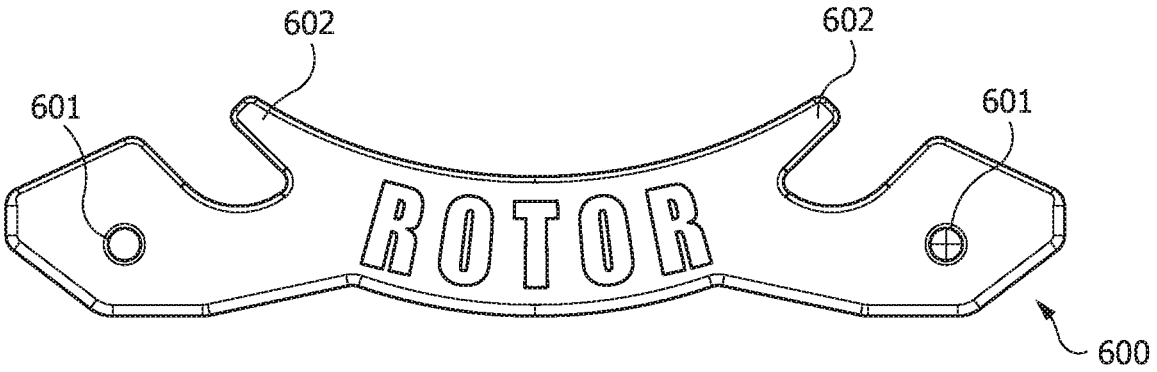
FIG. 23A shows a top view of an alternative embodiment of a coupler for adjoining a base and foot extension.

FIG. 23A shows a top view of an embodiment of a coupler 600, which can be configured to matingly adjoin with a recessed area provided in the base via projections 602. These projections are configured the same as corresponding projections formed in the connecting ends of the foot extension. See for example, 505 in FIG. 22. A coupler can be advantageous in that it can further include apertures 601 for receiving stakes or rods to be placed therethrough to secure the position of the base in place when a foot extension is not used with the base.

Figure 23B:
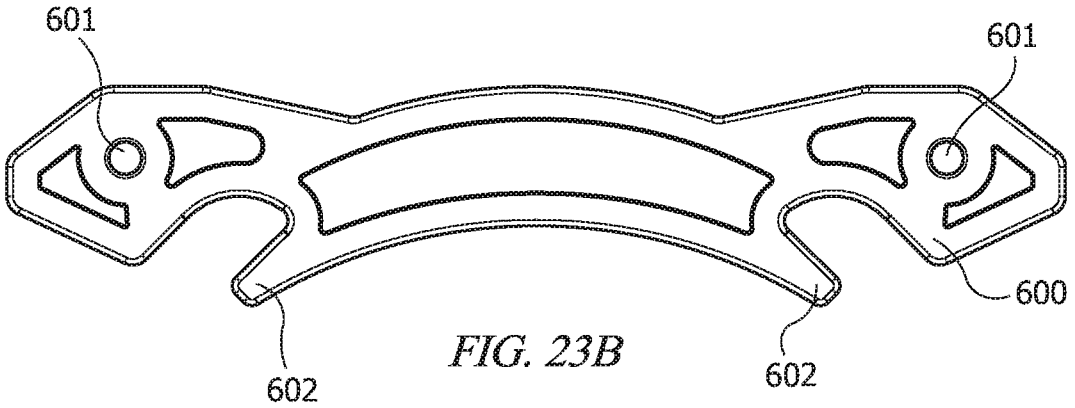
FIG. 23B shows a bottom view of the coupler shown in FIG. 23A.

FIG. 23B shows a bottom view of the coupler 600 shown in FIG. 23A. It would be understood that a coupler is provided and useful where the base is used without a foot extension. A coupler would also be understood to be, and is, useful when the foot extension and base are not matingly configured. The coupler can be used as an intermediate connecting piece to adjoin the base and foot extension in a stable configuration.

Figure 24:
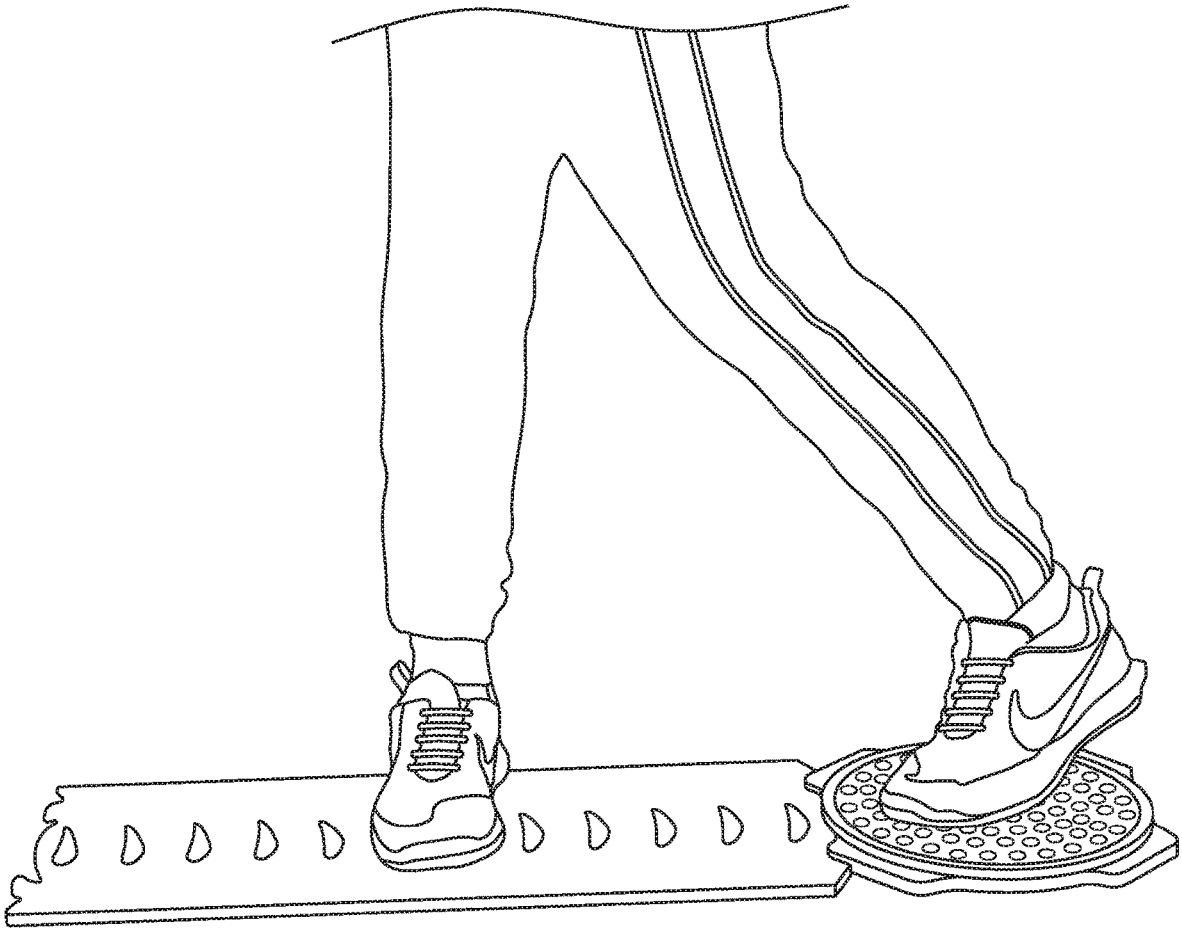
FIG. 24 shows an embodiment of a sporting device of the invention in use, illustrating an assembled sporting device having a base adjoined by two foot extensions, and the relative positioning of a user's feet on the sporting device during use.

FIG. 24 shows an embodiment of a sporting device of the invention in use, illustrating an assembled sporting device having a base adjoined by two foot extensions, and the relative positioning of a user's feet on the sporting device during use.

Now that the device has been described, the method of using the device will now be described. The device is first coupled to the foot extension. The stops are adjusted and secured in the necessary location to obtain the desired stance. As noted, the desired stance is the distance between the user's two feet.

The desired stance will be dictated by the sport they are practicing. As an example, as previously noted, for golfing a larger club will require a larger stance. Thus, the stops can be adjusted, and secured as necessary, to obtain the desired stance. The user places a first foot on the rotating plate, and a second foot on the foot extension. In one embodiment the second foot is located adjacent a stop. In another embodiment the foot is sandwiched between two adjacent stops.

Thereafter, the user applies a torque causing the first foot to rotate on the foot plate. The torque can be generated by a variety of activities including swinging a bat, throwing a ball, swinging a golf club, etc. As noted, by reducing the friction on the foot plate, the user is encouraged and trained to rotate the first foot. Further, simultaneously, the second foot is secured in the desired stance by the stops. This trains the user of the correct stance.

While the invention has been particularly shown and described with reference to a preferred embodiment, it will be understood by those skilled in the art that various changes in form and detail may be made therein without departing from the spirit and scope of the invention.

The invention claimed is:

1. A sporting device comprising:

a rotating foot plate having a top surface and a bottom surface, the rotating foot plate being operable to rotate less than 360°;

a ringed flange affixed to the bottom surface of the rotating footplate for stabilizing the footplate when the top surface of the rotating foot plate bears weight of a user on a peripheral edge thereof, and operable to engage a ball bearing cassette;

a base comprising a base floor and a peripheral side rim forming a recessed area within the base and bounding the rotating foot plate, the base floor having a retaining ring centrally disposed on the base floor and configured to receive a ball bearing cassette, the base further comprising at least one peripheral flange configured to matingly receive a foot extension, and a ball bearing cassette in a ring configuration wherein the ball bearing cassette is disposed below the bottom surface of the rotating foot plate and engaging the retaining ring within the recessed area of the base.

2. The sporting device of claim 1 wherein said base comprises a tab extending inwardly from the peripheral side rim for limiting rotation of the foot plate to less than 360°.

3. The sporting device of claim 1 wherein said base comprises two opposing tabs extending inwardly from the peripheral side rim for limiting rotation of the foot plate to less than 360°.

4. The sporting device of claim 1, wherein the base has a bottom face comprising gripping ridges.

5. The sporting device of claim 4, wherein the gripping ridges are linear and extend radially from a center of the bottom face of the base.

6. The sporting device of claim 1 wherein the base floor comprises at least one ridge for increased friction during rotation of the rotating foot plate.

7. The sporting device of claim 1 wherein the base floor comprises a plurality of ridges extending radially from the retaining ring to an inner circumference of the peripheral side rim.

8. The sporting device of claim 1 wherein the base floor comprises an annular ridge disposed between the retaining ring and an inner circumference of the peripheral side rim.

9. The sporting device of claim 1 wherein the top surface of the foot plate comprises knubs for gripping between the foot plate and a foot of a user of the sporting device.

10. The sporting device of claim 1 wherein the top surface of the foot plate comprises a cover having knubs for gripping between the foot plate and a foot of a user of the sporting device.

11. The sporting device of claim 1 wherein the foot plate comprises notches which engage with the at least one tab during rotation of the foot plate.

12. The sporting device of claim 1 further comprising at least one foot extension configured to engage with a recessed area on the base flange.

13. The sporting device of claim 1 wherein the at least one foot extension comprises a plurality of gaps formed along a midline thereof, and a cut-out area.

14. The sporting device of claim 12 wherein the at least one foot extension comprises an aperture for receiving a stake or rod for securing the foot piece to the ground.

15. The sporting device of claim 13 wherein the cut-out area comprises an aperture for receiving a stake or rod for securing the foot piece to the ground.

16. The sporting device of claim 1 further comprising a coupler which engages with the recessed area of the base flange, and wherein the coupler comprises an aperture for receiving a stake or rod for securing the base to the ground.

17. The sporting device of claim 1 further comprising two foot extensions wherein a first foot extension is configured at one end to engage with a recessed area on the base flange and is configured at another end to engage with the second foot extension.

18. The sporting device of claim 13 further comprising a foot stop which is disposable in the gap formed in the foot extension.

19. A method of practicing a swing motion for a sport using a bat or club, wherein the method comprises providing a device of claim 1;

placing one foot on the rotating foot plate and the other foot in front of the rotating foot plate in a stance normally taken by a user when swinging at a pitched or teed ball; and performing practice swings wherein the foot placed on the rotating foot plate is rotated such that the hips are swiveled in the direction of the rotation of the rotating plate.

20. A method of training on a sporting device, said method comprising:

providing a sporting device of claim 1;

engaging at least one foot extension to the base;

engaging at least one foot stop along the length of the foot extension to obtain a desired stance;

placing a first rotating foot on the foot plate;

placing a second off foot on the foot extension adjacent one of said at least one stop; and applying a torque to rotate said first rotating foot.

21. The method of claim 20 wherein said applying a torque comprises swinging a golf club.

22. The method of claim 20 wherein said applying a torque comprises swinging a baseball bat.

* * * * *